US008696149B2

(12) United States Patent
Chien et al.

(10) Patent No.: US 8,696,149 B2
(45) Date of Patent: Apr. 15, 2014

(54) STRUCTURES OF LUMINOUS UMBRELLA

(75) Inventors: Huan-Jan Chien, Zhudong Township, Hsinchu County (TW); Tsung-Hong Tsai, Puli Township, Nantou County (TW)

(73) Assignee: Tsung-Hong Tsai, Puli Township (TW)

( * ) Notice: Subject to any disclaimer, the term of this patent is extended or adjusted under 35 U.S.C. 154(b) by 333 days.

(21) Appl. No.: 13/087,804

(22) Filed: Apr. 15, 2011

(65) Prior Publication Data

US 2011/0260655 A1 Oct. 27, 2011

(30) Foreign Application Priority Data

Apr. 27, 2010 (TW) ..... 99113164 A

(51) Int. Cl.
*H05B 37/02* (2006.01)

(52) U.S. Cl.
USPC ..... 362/102; 362/577; 135/16

(58) Field of Classification Search
USPC ..... 362/577, 102, 109, 234, 253, 249.02, 362/294, 373, 800; 135/15.1, 910, 66, 16
See application file for complete search history.

(56) References Cited

U.S. PATENT DOCUMENTS

| | | | | |
|---|---|---|---|---|
| 4,860,179 | A * | 8/1989 | Mui et al. | 362/102 |
| 5,954,417 | A * | 9/1999 | Mai | 362/102 |
| 6,068,006 | A | 5/2000 | Murphy | |
| 6,270,230 | B1 * | 8/2001 | Mai | 362/102 |
| 6,341,873 | B1 * | 1/2002 | Yang | 362/102 |
| 2006/0096625 | A1 * | 5/2006 | Chen et al. | 135/16 |
| 2007/0041175 | A1 * | 2/2007 | Chang | 362/102 |
| 2007/0047222 | A1 | 3/2007 | Chang | |

FOREIGN PATENT DOCUMENTS

| | | | |
|---|---|---|---|
| CN | 2217326 | Y | 1/1996 |
| CN | 2927780 | Y | 8/2007 |
| DE | 10017274 | A1 | 10/2001 |
| GB | 339082 | A1 | 12/1930 |
| JP | 2215404 | A | 8/1990 |
| JP | 3057403 | A | 3/1991 |
| TW | M256706 | | 2/2005 |

* cited by examiner

*Primary Examiner* — Bao Q Truong
(74) *Attorney, Agent, or Firm* — McGlew and Tuttle, P.C.

(57) ABSTRACT

The present invention relates to an improvement in the structure of luminous umbrella, using integrated illumination components. The components are ideal for luminous umbrella particularly designed to be used in the evening when visibility is poor, and can be used for other decoration purposes. The integrated illumination components of the present invention are constructed by combining illumination emitter of LED with bases of parts of umbrella, such as linkage members on slip ring, rib members on fixed collar and umbrella handle. When the illumination emitter of LED is mounted on the surface of these parts, the overall umbrella structure can be made smaller and lighter, and the flexibility of light source design can also be maximized. In particular, when base parts with high heat dissipation capability are used as the heat dissipating fins, the full performance of high-brightness illumination emitter of LED can be achieved. The integrated illumination components offer another advantage. With the flexibility of design in the number of illumination emitter of LED and the angle of light projection, the components allow light to be fully projected onto the semi-transparent canopy, which turns luminous umbrella into a lantern with both illumination and warning functions when used at night. Umbrella users thus become obvious objects when walking at night. If color illumination emitter of LED is used, dazzling colored lighting design can be created to the satisfaction of both designers and users, achieving the decorative and aesthetic effect.

7 Claims, 28 Drawing Sheets

STRUCTURES OF LUMINOUS UMBRELLA

FIELD OF THE INVENTION

The present invention relates to the integrated illumination components, which are used to replace traditional umbrella parts to improve the umbrella structure. Integrated illumination components are constructed by combining illumination emitter of LED with bases of parts of umbrella, such as linkage members on slip ring, rib members on fixed collar and umbrella handle. When the illumination emitter of LED is mounted on the surface of these parts, the overall umbrella structure can be made smaller and lighter, and the flexibility of light source design can also be maximized. Application of the present invention turns luminous umbrella into a lantern with both illumination and warning functions, allowing umbrella users to become obvious objects when walking at rainy night and to see roads ahead.

BACKGROUND OF THE INVENTION

Luminous umbrella refers to an umbrella equipped with illumination component. Such type of umbrella has long been used to improve users' safety in the evening, particularly at rainy nights when pedestrians are unable to clearly see holes on the roads and card rivers are more likely to en danger pedestrians' safety due to poor visibility. The problems can be largely solved when illumination and warning functions are added. As a result, hundreds of related patents issued since 1930 have aimed to offer various solutions to achieve the goal. References cited for the present invention are as follows.

Reference One, GB339082A1 "Improvements in or relating to Umbrella, or Walking Stick, and the like" (issued in the UK, 1930), discloses an umbrella in which a light bulb and batteries are installed in the handle to offer illumination and increase user's safety. The light bulb fitted in the handle is used to illuminate the ground and area ahead.

Reference Two, JP2215404A (issued in Japan, 1990), discloses an umbrella in which an LED device is fitted on the top column with batteries being installed on top of the umbrella pole under the canopy as well as in the handle. The LED device is illuminated when the umbrella is opened, so as to make the user more visible to car drivers when walking at night.

Reference Three, JP305 7403A (issued in Japan, 1991), discloses an umbrella in which a light-emitting source is added to the top column with a revolving illumination device being installed in the lower part of the handle and the batteries being installed in the handle. The LED light at the top of the umbrella is illuminated for the safety of pedestrians when the umbrella is opened, so as to make the user more visible to card rivers when walking at night. The safety of pedestrians can be further improved with the revolving illumination device fitted in the lower part of the handle, which illuminates the ground and area ahead.

Reference Four, CN2217326Y (issued in China, 1996), also discloses an umbrella in which illumination devices are fitted on the top column and in the handle.

Reference Five, U.S. Pat. No. 6,068,006A1 (issued in the US, 2000), discloses an umbrella in which a light source unit is installed on the side of the top of the shaft, allowing the light to be fully projected unto the inner canopy. The light is then reflected downwardly to illuminate the surrounding area of the user, also serving as a warning sign to increase the safety of users.

Reference Six, DE 10017274A 1(issued in Germany, 2000), discloses an umbrella in which an LED device equipped with batteries and switch is attached to the top column with screw threads. For the safety of pedestrians at night, the LED light is illuminated when the umbrella is opened. The umbrella can also be used as a flashlight to illuminate the road ahead for the user when it is closed, further increasing user' safety.

Reference Seven, TW-M256706 (issued in Taiwan, 2005), discloses an umbrella in which a slot seat is attached to the slip ring. The slip ring and slot seat are integrated into one unit, in which multiple parallel LED illumination components are installed. The unit is also fitted with batteries and power switch for users to switch on or off the LED light.

Reference Eight, CN2927780Y (issued in China, 2007), discloses an umbrella in which batteries and LED light are installed in the curved handle to offer warning and illumination functions. The LED light installed in the curved handle illuminates the ground and area ahead. With transparent cover, light is projected to achieve the illumination and warning functions.

Reference Nine, US2007/0047222A1 (issued in the US, 2007), discloses an umbrella in which an LED device is attached to the top column with batteries and power switch being installed inside the shaft at the position close to the upper part of shaft beneath the canopy. User can switch on or off the LED light when the umbrella is opened and used at night.

In all the references cited, the light sources used range from traditional light bulbs to modern LED lights, and the posit ions for installation include top column, the upper part of shaft and handle. The design of using completely packaged LED light significantly improves the illumination effect, increasing the safety of users at night. Most of these solutions focus on structure improvement, either modifying the original structures to accommodate the additional light sources or directly attaching illumination devices to the umbrellas. Nevertheless, most of the solutions do not adopt the high-brightness LED lights and the required heat dissipation devices, suggesting that the weights of umbrellas and complexity of component arrangements increase and that the illumination effect fails to truly meet the users' need. Also, the life of LED light is shortened. All these issues make the umbrellas inconvenient and impractical to use. The problems of currently known technologies are as follows:

Changing original structure design to accommodate additional light sources or attaching illumination devices to the umbrellas lead to increase the weights of umbrellas as well as the complexity of component arrangements.

Design flexibility is limited if completely packaged LED components are used for additional or attached light sources. As the structure, brightness and dimension are predetermined, the light effect may not be able to fully meet the users' need. The design for heat dissipation is also unable to be taken into consideration. Moreover, layout of the required lead wires becomes another factor affecting the design of space.

Using completely packaged LED components makes the method of improving illumination effect with high-brightness LED light infeasible, as the heat dissipation substrate used for the light-emitting semiconductor parts is packaged at the same time with only leads or electric contacts being exposed. Strong heat dissipation capability is required if high-brightness LED light source is to be used. High temperature leads to decline in the light transmission rate of the LED components, the illumination efficiency and the length of service life. Ultimately, the overall brightness is not sufficient enough to meet the users' need.

SUMMARY OF THE INVENTION

The present invention aims to improve the problems found in the above-mentioned solutions, which adopt additional or attached light sources, and proposes a solution of using integrated illumination components. The solution proposed is to combine illumination emitter of LED with other umbrella parts. The heat dissipation substrate used for the illumination emitter of LED is exposed and not packaged; it is also firmly mounted on the surface of heat dissipation base of umbrella parts. All the electric components used for the present invention meet the necessary electric insulation and safety requirements. Umbrella parts to be integrated include linkage members on slip ring, rib members on fixed collar and umbrella handle. When the illumination emitter of LED is mounted on the surface of these parts, the overall umbrella structure can be made smaller and lighter, and the flexibility of light source design can also be maximized. In particular, when umbrella parts with high heat dissipation capability are used as the heat dissipating fins, the need of heat dissipation required by high-b rightness illumination emitter of LED can be fulfilled. Service life of the illumination emitter of LED can also be significantly prolonged. Moreover, the partly packaged illumination emitter of LED not only becomes smaller in size, but also allows designers to meet various illumination needs, including the degree of brightness and choice of colors, through multiple settings and allocation plans. The flexibility in light design allows light to be completely projected to the inner canopy and to be evenly radiated through the semi-transparent canopy, which turns umbrella into a lantern with both illumination and warning functions when used at night. Umbrella users also become obvious objects when walking at night. In addition, flexible packaging method used for illumination components allows designers to create dazzling effect of colored lighting as well as to achieve the decorative and aesthetic effect with the light projected to the semi-transparent canopy.

DETAILED DESCRIPTION OF THE INVENTION

The four embodiments described below are given to further elaborate the present invention, a solution of using integrated illumination component constructed by combining illumination emitter of LED with other umbrella parts. All the electric components used for the present invention meet the necessary electric insulation and safety requirements.

Refer to FIGS. 1-9 for the first embodiment, which is shown with most details.

Refer to FIGS. 10-14 for the second embodiment.

Refer to FIGS. 15-18 for the third embodiment.

Refer to FIGS. 19-21 for the fourth embodiment.

Description of the First Embodiment

FIG. 1 illustrates the structure of the first embodiment of the present invention when integrated illumination components are used in a luminous umbrella. A luminous umbrella 1 is composed of flexible canopy 10, shaft 11, plate spring 111, pressing switch 12, electric wire 13, handle 14, battery 15, top column 16, ribs 17 and linkages 18. The linkage members on slip ring assembly 2, rib members on fixed collar assembly 3 and umbrella handle illumination assembly 9 are the integrated illumination components.

Plate spring 111 and pressing switch 12 are fitted on the shaft 11 of the above-mentioned umbrella. Electric wire 13 is installed in the hollow part of the shaft 11. The top column 16 is fitted on the distal end of the shaft. The handle 14, battery 15 and umbrella handle illumination assembly 9 are fitted on the lower end of the shaft 11.

The linkage members 18 on slip ring assembly 2 and rib members 17 on fixed collar assembly 3 are installed on the upper part of the shaft 11. There are holes (not illustrated) reserved for electric wire 13 and wires of the illumination body. The ribs 17 are connected to linkages 18 with pivots, and the two parts are fixed with pivots on rib members on fixed collar assembly 3 and linkage members on slip ring assembly 2, respectively. The flexible canopy 10 is fixed on the ribs 17. The umbrella can be opened and closed via the upward and downward sliding of linkage members on slip ring assembly 2 along the shaft 11.

When the umbrella is opened, linkage members on slip ring assembly 2 is propped up by plate spring 111, allowing the umbrella to remain open. At this time, the wire contact on the linkage members on slip ring assembly 2 comes into contact with that on the rib members on fixed collar assembly 3, constituting a set of circuit switch. When the pressing switch 12 is in a "closed" state, the circuit is activated and the LED illumination device will light up. The inner side of the flexible canopy 10 will be illuminated by the illumination emitter of LED fitted on the linkage members on slip ring assembly 2 and that on the rib members on fixed collar assembly 3. The umbrella handle illumination assembly 9 will illuminate the roads ahead for the users. If the umbrella is to be used in a fixed location and for a long period of time, external power source, instead of batteries, can be adopted.

FIG. 2 illustrates the structure of the illumination emitter of LED used in the present invention. The illumination emitter of LED 4 comprises the LED substrate 44, transparent package of illumination semiconductor 41, positive/negative wire contact 42 and wire contact 43. The bottom surface of LED substrate 441 is attached to the surface of the base of umbrella parts. All the electric components used in the device meet the necessary electric insulation and safety requirements.

FIG. 3 illustrates the circuit diagram of the first embodiment. The diagram presents the required electric circuit for installing the illumination emitter of LED 4. All the electric components referred to in the diagram meet the necessary electric insulation and safety requirements. The two-core electric wire 13 is composed of electric wire 131 and electric wire 132 and is used to form a circuit for connection with pressing switch 12, battery 15, the linkage members on slip ring assembly 2 and the rib members on fixed collar assembly 3. It is also used for connection with the branch parallel circuit of electric wire 13, formed by linking electric wire 133 and electric wire 134, for the umbrella handle illumination assembly 9 on the handle 14. Electric circuit fixed contact 921 and electric circuit fixed contact 922 are on the branch parallel circuit of electric wire 13, and are used for connection with the umbrella handle illumination assembly 9.

LED assembly on slip ring 21 is composed of LED assembly on slip ring 211 and LED assembly on slip ring 212, all of which are linked with wire on slip ring 201, wire on slip ring 202 and wire on slip ring 203. LED assembly on slip ring 211 and LED assembly on slip ring 212 are created with parallel circuit connecting to the illumination emitter of LED 4. The end point of wire on slip ring 202 is electric contact on slip ring 22, and the end point of wire on slip ring 201 is electric contact on slip ring 23. The two contacts are used to connect with electric contact on fixed collar 32 and electric contact on fixed collar 33, respectively, to form a circuit.

LED assembly on fixed collar 31 is composed of electric wire on fixed collar 301, electric wire on fixed collar 303 and the illumination emitter of LED with the former two connecting to the illumination emitter of LED in respective parallel circuits. The end point of electric wire on fixed collar 303 is electric contact on fixed collar 33. The end point of electric wire on fixed collar 301 is power wire contact on fixed collar 341, which connects to electric wire 131. Electric wire on fixed collar 302 is an independent wire, of which one end point is power wire contact on fixed collar 342, connecting to electric wire 132, and the other end point is electric contact on fixed collar 32.

When the umbrella is closed, linkage members on slip ring assembly 2 is moved downwardly to the upper part of handle 14 and separated from rib members on fixed collar assembly 3, creating an open circuit. At this time, all the LED illumination components are not charged and do not light up. When the umbrella is opened, linkage members on slip ring assembly 2 is moved up to be fixed on the plate spring 111 on the shaft 11, making electric contact on fixed collar 33 and electric contact on fixed collar 32 to join together with electric contact on slip ring 23 and electric contact on slip ring 22, respectively, thus forming a complete circuit. When the pressing switch 12 is in a "closed" state, all the LED illumination components will be charged and light up.

FIG. 4(*a*) illustrates the detailed structure of the umbrella handle illumination assembly of the present invention. The umbrella handle illumination assembly 9 is part of the integrated illumination component and is made of light metal alloy or engineering plastic materials with high heat dissipation capability. It can be divided into top surface with thread 961, heat dissipating fin 94 and bottom circumference surface 962. Top surface with thread 961 is fixed beneath the handle 14. Heat dissipating fin 94 is used to increase the area of heat dissipation for the illumination emitter of LED 4. Bottom circumference surface 962 is used to install the LED assembly 91 with transparent package of LED assembly 95, resin or silicone, being applied to protect and fix the unit. Wire of LED assembly 91 passes through the central hole of handle 97 to connect with electric wire 133 and electric wire 134 at electric circuit fixed contact 921 and electric circuit fixed contact 922, respectively, to form the circuit. Multiple heat dissipating fins 94 can be used for the device to meet the heat dissipation need.

FIG. 4(*b*) illustrates another detailed structure of the umbrella handle illumination assembly of the present invention. A commonly seen curved handle is used for the present embodiment to show how the umbrella handle illumination assembly 9 can be installed.

FIG. 5 illustrates the detailed structure of the illumination device used in the first embodiment of the present invention. The linkage members on slip ring assembly 2 and rib members on fixed collar assembly 3 are embodiments of the integrated illumination components of the present invention. The bases of the linkage members on slip ring assembly 2 and rib members on fixed collar assembly 3 are made of materials with high heat dissipation capability.

There are multiple slots on out surface of slip ring 26 of the linkage members on slip ring assembly 2. Fixed pins of linkages 181 are used to fix linkages 18. LED assembly on slip ring 21 is fitted on top circumferential surface of slip ring 264 and can be further divided into LED assembly on slip ring 211 and LED assembly on slip ring 212, connecting to electric contact on slip ring 22 and electric contact on slip ring 23, respectively. LED assembly on slip ring 21 is assembled in advance or is directly assembled on the base with transparent package of LED assembly on slip ring 25 being completed subsequently with transparent materials. The heat of LED assembly on slip ring 21 is transmitted via the base of great heat transfer capability and through the out surface of slip ring 26 as well as multiple slots to the atmosphere in order to lower the temperature of transparent package of illumination semiconductor 41.

There are multiple slots on out surface of fixed collar 36 of the rib members on fixed collar assembly 3. Fixed pins of ribs 171 are used to fix the ribs 17. LED assembly on fixed collar 31 is fitted on the bottom circumferential surface of fixed collar 362 (not illustrated), connecting to electric contact on fixed collar 32 and electric con tact on fixed collar 33, respectively. LED assembly on fixed collar 31 is assembled in advance or is directly assembled on the base with transparent package of LED assembly on fixed collar 35 being completed subsequently with transparent materials. LED assembly on fixed collar 31 connects with electric wire 131 and electric wire 132 at power wire contact on fixed collar 341 and power wire contact on fixed collar 342, respectively. The circuit is made complete by electric wire on fixed collar 301 and electric wire on fixed collar 302, which pass through the hole (not shown) on the base of shaft 11 to be welded to electric wire 131 and electric wire 132 at power wire contact on fixed collar 341 and power wire contact on fixed collar 342 on the top of the shaft. With the rib members on fixed collar assembly 3 having good thermal conductivity and the out surface of fixed collar 36 as well as the slots offering heat dissipation function, the heat of LED assembly on fixed collar 31 can be transmitted via these surfaces, thus lowering the temperature of transparent package of illumination semiconductor 41.

The distal end of shaft 11 is sealed with top column 16. Flexible canopy 10 is fixed with the rib members on fixed collar assembly 3 and is closely connected to top column 16 with fixed cover of flexible canopy 101 to prevent the rain from infiltrating into the inner section of umbrella.

FIG. 6 illustrates the detailed structure of the LED illumination device of linkage members on slip ring assembly used in the first embodiment of the present invention. Through the central hole of slip ring for shaft 27, the linkage members on slip ring assembly 2 can be fitted on the shaft and slid along the shaft. The out surface of slip ring 26 forms the outer part of the linkage members on slip ring assembly 2 and can be further divided into bottom circumferential surface of slip ring 262, middle circumferential surface of slip ring 263, top circumferential surface of slip ring 264 and holding surface of slip ring 265.

The middle circumferential surface of slip ring 263 is designed with circumferential slots of slip ring 28, radial slots of slip ring 281 and radial slots of slip ring 282 to accommodate one end of the linkages 18. Fixed pins of linkages 181 are used to fix the linkages 18 on the circumferential slots of slip ring 28. LED assembly on slip ring 21 is fitted on the top circumferential surface of slip ring 264. LED assembly on slip ring 21 can be further divided into LED assembly on slip ring 211 and LED assembly on slip ring 212, which are linked by wire on slip ring 201, wire on slip ring 202 and wire on slip ring 203 and connect to electric contact on slip ring 22 and electric contact on slip ring 23, respectively. The middle circumferential surface of slip ring 263 is with good heat dissipation capability and the slots offer the same heat dissipation function as heat dissipating fins do. The bottom circumferential surface of slip ring 262 and holding surface of slip ring 265 can be used for heat dissipation as well. The heat of LED assembly on slip ring 21 can be transmitted via these surfaces, thus lowering the temperature of transparent package of illumination semiconductor 41. The illumination components of LED assembly on slip ring 211 and LED assembly on slip ring 212 are placed on annular surface, so the light is able to illuminate every corner of inner canopy. The number of illumination components and the angle of projection can also be adjusted according to different demands.

FIG. 7(*a*) illustrates the 3D detailed structure of linkage members on slip ring assembly used in the first embodiment of the present invention. The figure presents the actual installation, in particular, the positions of the LED assembly on slip ring 211, LED assembly on slip ring 212, wire on slip ring 201, wire on slip ring 202, wire on slip ring 203, electric contact on slip ring 22 and electric contact on slip ring 23.

FIG. 7(*b*) illustrates the 3D detailed structure of the base of linkage members on slip ring assembly used in the first embodiment of the present invention. The figure elaborates that when installing the illumination emitter of LED 4, the bottom surface of LED substrate 441 has to be tightly stuck to adhering surface of LED substrate at top circumferential surface of slip ring 266 in order to allow the heat to be completely transmitted via LED substrate 44 to the base of linkage members on slip ring assembly 2, achieving the goal of lowering the temperature of illumination emitter of LED 4.

FIG. 8 illustrates the detailed structure of rib members on fixed collar assembly used in the first embodiment of the present invention. Electric wire on fixed collar 301 and electric wire on fixed collar 302 connect to power wire contact on fixed collar 341 and power wire contact on fixed collar 342, both located in the central hole of fixed collar for shaft 37, via electric wire slots of fixed collar 383 feed through hole of electric wire on fixed collar 393 and electric wire slots of fixed collar 384 feed through hole of electric wire on fixed collar 392, respectively. For the installation of illumination emitter of LED 4 on the LED assembly on fixed collar 31, relative positions of electric contact on fixed collar 32 and electric contact on fixed collar 33 should be taken into consideration at the same time.

The out surface of fixed collar 36 of the base of rib members on fixed collar assembly 3 can be further divided into top surface of fixed collar 361, bottom circumferential surf ace of fixed collar 362, middle circumferential surface of fixed collar 363 and top circumferential surface of fixed collar 364. The flexible canopy 10 is sealed by combining top surface of fixed collar 361 and fixed cover of flexible canopy 101. Passed through the central hole (not shown) of the flexible canopy 10, top circumferential surface of fixed collar 364 is used to fix the flexible canopy 10. Bottom circumferential surface of fixed collar 362 is used for the installation of LED assembly on fixed collar 31, in which electric wire on fixed collar 301, electric wire on fixed collar 302 and electric wire on fixed collar 303 are used to connect to the illumination emitter of LED 4, electric contact on fixed collar 32 and electric contact on fixed collar 33.

The middle circumferential surf ace of fixed collar 363 is designed with circumferential slots of fixed collar 38, radial slots of fixed collar 381, radial slots of fixed collar 382 and electric wire slots of fixed collar 383, feed through hole of electric wire on fixed collar 393, electric wire slots of fixed collar 384, feed through hole of electric wire on fixed collar 392 and fixed collar with central hole for shaft 391. Fixed pins of ribs 171 are used to fix ribs 17 on the circumferential slots of fixed collar 38. Radial slots of fixed collar 381 and radial slots of fixed collar 382 are used to accommodate one end of ribs 17 to allow the umbrella to be opened or closed. The slots offer the same heat dissipation function as heat dissipating fins do. Fixed pins are used to fix rib members on fixed collar assembly 3 on the top of the shaft via fixed collar with pin hole 391.

FIG. 9 illustrates the 3D detailed structure of rib members on fixed collar assembly used in the first embodiment of the present invention. The figure presents that illumination emitters of LED 4 are placed on annular surface. Relative positions of electric contact on fixed collar 32 and electric contact on fixed collar 33 are to be considered at the same time. The light is able to illuminate every corner of inner canopy. The number of illumination components and the angle of projection can also be adjusted according to different demands.

Description of the Second Embodiment

FIG. 10(*a*) illustrates the structure of the second embodiment of the present invention when integrated illumination components are used in a luminous umbrella. A luminous umbrella 1 is composed of flexible canopy 10, shaft 11, plate spring 111, pressing switch 12, electric wire 13, handle 14, battery 15, ribs 17, linkages 18, linkage members on slip ring assembly 6, rib members on fixed collar assembly 5 and umbrella handle illumination assembly 9.

Plate spring 111 and pressing switch 12 are fitted on the shaft 11. Electric wire 13 is installed in the hollow part of the shaft 11. On the distal end of the shaft, the rib members on fixed collar assembly 5 are stretched through canopy to form the structure of top column. The handle 14, battery 15 and umbrella handle illumination assembly 9 are fitted on the lower end of the shaft 11.

The linkage members on slip ring assembly 6 and rib members on fixed collar assembly 5 are installed on the upper part of the shaft 11. There are holes (not shown) reserved for electric wire 13 and wires of the illumination body. The ribs 17 are connected to linkages 18 with pivots, and the two parts are fixed with pivots on rib members on fixed collar assembly 5 and linkage members on slip ring assembly 6, respectively. The flexible canopy 10 is fixed on the ribs 17. The umbrella can be opened and closed via the upward and downward sliding of linkage members on slip ring assembly 6 along the shaft 11.

When the umbrella is opened, linkage members on slip ring assembly 6 are propped up by plate spring 111, allowing the umbrella to remain open. At this time, the wire contact on the linkage members on slip ring assembly 6 comes into contact with that on the rib members on fixed collar assembly 5, constituting a set of circuit switch. When the pressing switch 12 is in a "closed" state, the circuit is activated and the LED illumination device will light up. The light is able to illuminate every corner of inner canopy. The number of illumination components and the angle of projection can also be adjusted according to different demands. If the umbrella is to be used in a fixed location and for a long period of time, external power source, instead of batteries, can be adopted.

FIG. 10(*b*) illustrates another structure of the second embodiment of the present invention when integrated illumination components are used in a luminous umbrella. When the umbrella is opened and when the linkage members on slip ring assembly 6 and the rib members on fixed collar assembly 5 are fitted on the shaft 11 without direct contact with each other, switch assembly of slip ring 69 is installed as to be able to slide along the shaft 11. Users push the switch assembly of slip ring 69 up to the position in which it can be tightly propped up by plate spring 113 and comes into close contact with the rib members on fixed collar assembly 5. Electric circuit and wire contacts are fitted on the switch assembly of slip ring 69, replacing the circuit set on the linkage members on slip ring assembly 6. The wire contacts are to be in direct contact with those on the rib members on fixed collar assembly 5, constituting a complete circuit. When the umbrella is closed, the plate spring 113 is loosened and the switch assembly of slip ring 69 slides down, creating an open circuit.

FIG. 11(*a*) illustrates the circuit diagram used in the second embodiment of the present invention. The diagram shows the relations among the illumination components and umbrella parts. All the electric components referred to in the diagram meet the necessary electric insulation and safety requirements. The two-core electric wire 13 is composed of electric wire 131 and electric wire 132 and is used to form a circuit for connection with pressing switch 12, battery 15, the linkage members on slip ring assembly 6 and the rib members on fixed collar assembly 5. It is also used for connection with the branch parallel circuit of electric wire 13, formed by linking electric wire 133 and electric wire 134, for the umbrella handle illumination assembly 9 on the handle 14. Electric circuit fixed contact 921 and electric circuit fixed contact 922 are on the branch parallel circuit of electric wire 13, and are used for connection with the umbrella handle illumination assembly 9.

LED assembly on fixed collar 51 is composed of LED assembly on fixed collar 511, LED assembly on fixed collar 512 and LED assembly on fixed collar 513. Electric wire on fixed collar 501, electric wire on fixed collar 502 and electric wire on fixed collar 503 connect to electric wire on fixed collar 504, respectively. The end point of electric wire on fixed collar 501 is electric contact on fixed collar 521, which connects to electric contact on slip ring 621. The end point of electric wire on fixed collar 502 is electric contact on fixed collar 522, which connects to power wire contact on fixed collar 342 to form a circuit. Electric contact on fixed collar 523 is an independent contact, which is used to connect with power wire contact on fixed collar 341 and electric contact on slip ring 623.

On the slip ring, there are an independent wire on slip ring 601, electric contact on slip ring 621 and electric contact on slip ring 623. Electric contact on slip ring 623 connects to the electric contact on fixed collar 523, and electric contact on slip ring 621 connects to electric contact on fixed collar 521. These two sets of contacts become the other switch in the circuit.

When the umbrella is closed, linkage members on slip ring assembly 6 is moved downwardly to the upper part of handle 14 and separated from rib members on fixed collar assembly 5, creating an open circuit. At this time, all the LED illumination components are not charged and do not light up. When the umbrella is opened, linkage members on slip ring assembly 6 is moved up to be fixed on the plate spring 111 on the shaft 11, making electric contact on fixed collar 521 and electric contact on fixed collar 523 to join together with electric contact on slip ring 621 and electric contact on slip ring 623, respectively, thus forming a complete circuit. When the pressing switch 12 is in a "closed" state, all the LED illumination components will be charged and light up.

FIG. 11(*b*) illustrates an other circuit diagram used in the second embodiment of the present invention when integrated illumination components are used in a luminous umbrella. When the umbrella is opened and when the linkage members on slip ring assembly 6 and the rib members on fixed collar assembly 5 are fitted on the shaft 11 with out direct contact with each other, electric wire 692, wire contact 691 and wire contact 693 are fitted on the switch assembly of slip ring 69, replacing the circuit set on the linkage members on slip ring assembly 6. The wire contacts are to be in direct contact with those on the rib members on fixed collar assembly 5, constituting a complete circuit. When the umbrella is closed, the switch assembly of slip ring 69 slides down, so as to create an open circuit.

FIG. 12(*a*) illustrates the detailed structure of the illumination device used in the second embodiment of the present invention. The linkage members on slip ring assembly 6 and rib members on fixed collar assembly 5 are embodiments of the integrated illumination components of the present invention. The bases of the linkage members on slip ring assembly 6 and rib members on fixed collar assembly 5 are made of materials with high heat dissipation capability.

There are multiple slots on out surface of slip ring of the linkage members on slip ring assembly 6, so the fixed pins of linkages 181 can be used to fix linkages 18. Wire on slip ring 601, electric contact on slip ring 621 and electric contact on slip ring 623 are fitted on the base of the linkage members on slip ring assembly 6. The two contacts will be used as the circuit switch. Wire on slip ring 601, electric contact on slip ring 621 and electric contact on slip ring 623 are assembled in advance or are directly assembled on top circumferential surface of slip ring 661 with transparent package of LED assembly on slip ring 65 being completed subsequently with transparent materials.

The LED assembly on fixed collar 51 fitted on the rib members on fixed collar assembly 5 can be further divided into LED assembly on fixed collar 511, LED assembly on fixed collar 512 and LED assembly on fixed collar 513. LED assembly on fixed collar 512 and LED assembly on fixed collar 513 are installed on the bottom circumferential surface of fixed collar 562 beneath the canopy. LED assembly on fixed collar 511 is installed on the extension circumferential surface of fixed collar 564 above the flexible canopy 10.

The illumination emitter of LED 4 of LED assembly on fixed collar 51 is connected with electric contact on fixed collar 521 and electric contact on fixed collar 522 via electric wire on fixed collar 501, electric wire on fixed collar 502, electric wire on fixed collar 503 and electric wire on fixed collar 504. Electric contact on fixed collar 523 is an independent contact, which is used to connect with power wire contact on fixed collar 341 and electric contact on slip ring 623. Therefore, the light originated from LED assembly on fixed collar 512 and LED assembly on fixed collar 513 will be projected to the inner section of the flexible canopy 10. The light from LED assembly on fixed collar 511 will be sent out in all directions.

The base of the rib members on fixed collar assembly 5 will be extended in upward direction. The extension will increase the height of top circumferential surface of fixed collar 563, and create the extension circumferential surface of fixed collar 564, making it possible for the rib members on fixed collar assembly 5 to replace the top column 16. LED assembly on fixed collar 51 is assembled in advance or is directly assembled on out surface of fixed collar 56 with package of LED assembly on fixed collar 55 being completed subsequently with transparent materials. The package of LED assembly on fixed collar 55 can be further divided into the transparent package of LED assembly on fixed collar 551 beneath the canopy and transparent package of LED assembly on fixed collar 552 at the top end of umbrella.

FIG. 12(*b*) illustrates another detailed structure of the illumination device used in the second embodiment of the present invention when integrated illumination components are used in a luminous umbrella. When the umbrella is opened and when the linkage members on slip ring assembly 6 and the rib members on fixed collar assembly 5 are fitted on the shaft 11 without direct contact with each other, switch assembly of slip ring 69 is installed as to be able to slide along the shaft 11, whose base is made of materials with high heat dissipation capability.

Electric wire 692, wire contact 691 and wire contact 693 are fitted on the circumferential surface of switch assembly of slip ring 696. The circuit is protected by the protective package 695. Switch assembly of slip ring 69 is installed to replace the circuit on the linkage members on slip ring assembly 6. When the umbrella is closed, the plate spring 113 is loosened and the switch assembly of slip ring 69 slides down, creating an open circuit.

FIG. 13 illustrates the 3D detailed structure of rib members on fixed collar assembly used in the second embodiment of the present invention. The figure presents that illumination emitters of LED 4 are placed on two annular surfaces. Relative positions of electric contact on fixed collar 523 and electric contact on fixed collar 521 are to be considered at the same time. The light is able to illuminate every corner of inner canopy and the area above the flexible canopy 10. The number of illumination components and the angle of projection can also be adjusted according to different demands.

Actual installation of LED assembly on fixed collar 51 for the rib members on fixed collar assembly 5 is described below. The two ends of LED assembly on fixed collar 511 are electric wire on fixed collar 503 and electric wire on fixed collar 502. Electric wire on fixed collar 503 is placed on the extension circumferential surface of fixed collar 564. Electric wire on fixed collar 502 and electric wire on fixed collar 503 are connected with the bottom circumferential surface of fixed collar 562 via electric wire slots of fixed collar 583 and feed through hole of electric wire on fixed collar 592. Electric wire on fixed collar 503 connects to LED assembly on fixed collar 512, and electric wire on fixed collar 502 connects to electric contact on fixed collar 522. Electric wire 132 passes through the hole on the shaft 11 and feed through hole of electric wire on fixed collar 591, and is welded to power wire contact on fixed collar 342 (not shown).

LED assembly on fixed collar 512 and LED assembly on fixed collar 513 are linked together with electric wire on fixed collar 504, and are connected with electric contact on fixed collar 521. Electric contact on fixed collar 523 is an independent contact. Electric wire 131 passes through the wall hole (not shown) of the shaft 11 via the central hole of the shaft 11, connecting with electric contact on fixed collar 523 at power wire contact on fixed collar 341. With the base of the rib members on fixed collar assembly 5 having good thermal conductivity and out surface of fixed collar, including top surface of fixed collar 561, bottom circumferential surface of fixed collar 562, top circumferential surface of fixed collar 563 and extension circumferential surface of fixed collar 564, as well as the slots offering heat dissipation function, the heat of LED assembly on fixed collar 51 can be transmitted via these surfaces, thus lowering the temperature of transparent package of illumination semiconductor 41. The rib members on fixed collar assembly 5 are fitted on the shaft 11 with pin hole 593.

FIG. 14 illustrates the 3D detailed structure of linkage members on slip ring assembly used in the second embodiment of the present invention. The figure presents the details of linkage members on slip ring assembly 6. The middle circumferential surface of slip ring 662 is designed with circumferential slots of slip ring 68, radial slots of slip ring 681 and radial slots of slip ring 682, and is used to fix the end of linkages 18. Wire on slip ring 601 and its two ends, electric contact on slip ring 621 and electric contact on slip ring 623, are shown. The shaft 11 is fitted through the central hole of slip ring for shaft 67, allowing linkage members on slip ring assembly 6 to slide up and down easily.

Description of the Third Embodiment

FIG. 15(*a*) illustrates the structure of the third embodiment of the present invention when integrated illumination components are used in a luminous umbrella. A luminous umbrella 1 is composed of flexible canopy 10, shaft 11, plate spring 111, pressing switch 12, electric wire 13, handle 14, battery 15, ribs 17, linkages 18, linkage members on slip ring assembly 8, rib members on fixed collar assembly 7 and umbrella handle illumination assembly 9.

Plate spring 111 and pressing switch 12 are fitted on the shaft 11. Electric wire 13 is installed in the hollow part of the shaft 11. The top column 16 is fixed on the distal end of the shaft. The handle 14, battery 15 and umbrella handle illumination assembly 9 are fitted on the lower end of the shaft 11.

The linkage members on slip ring assembly 8 and rib members on fixed collar assembly 7 are installed on the upper part of the shaft 11. There are holes (not shown) reserved for electric wire 13 and wires of the illumination body. The ribs 17 are connected to linkages 18 with pivots, and the two parts are fixed with pivots on rib members on fixed collar assembly 7 and linkage members on slip ring assembly 8, respectively. The flexible canopy 10 is fixed on the ribs 17. The umbrella can be opened and closed via the upward and downward sliding of linkage members on slip ring assembly 8 along the shaft 11.

When the umbrella is opened, linkage members on slip ring assembly 8 are propped up by plate spring 111, allowing the umbrella to remain open. At this time, the wire contact on the linkage members on slip ring assembly 8 comes into contact with that on the rib members on fixed collar assembly 7, constituting a set of circuit switch. When the pressing switch 12 is in a "closed" state, the circuit is activated and the LED illumination device will light up. If the umbrella is to be used in a fixed location and for a long period of time, external power source, instead of batteries, can be adopted.

FIG. 15(*b*) illustrates an other structure of the third embodiment of the present invention when integrated illumination components are used in a luminous umbrella. When the umbrella is opened and when the linkage members on slip ring assembly 8 and the rib members on fixed collar assembly 7 are fitted on the shaft 11 without direct contact with each other, switch assembly of fixed collar 79 is fixed on the shaft 11. Electric circuit and wire contacts are fitted on the switch assembly of fixed collar 79, replacing the circuit set on the rib members on fixed collar assembly 7. The wire contacts are to be in direct contact with those on the linkage members on slip ring assembly 8, constituting a complete circuit. When the umbrella is opened, user pushes the linkage members on slip ring assembly 8 up to the position in which it can be tightly propped up by plate spring 111 and comes into close contact with the switch assembly of fixed collar 79, constituting a complete circuit. When the umbrella is closed, the plate spring 111 is loosened and the linkage members on slip ring assembly 8 slides down, creating an open circuit.

FIG. 16(*a*) illustrates the circuit diagram used in the third embodiment of the present invention. The diagram shows the relations among the illumination components and umbrella parts. All the electric components referred to in the diagram meet the necessary electric insulation and safety requirements. The two-core electric wire 13 is composed of electric wire 131 and electric wire 132 and is used to form a circuit for connection with pressing switch 12, battery 15, the linkage members on slip ring assembly 8 and the rib members on fixed collar assembly 7. The branch parallel circuit of electric wire 13 for the illumination assembly 9 on the handle 14 is formed by linking electric wire 133 and electric wire 134. Electric circuit fixed contact 921 and electric circuit fixed contact 922 are on the branch parallel circuit of electric wire 13, and are used for connection with the umbrella handle illumination assembly 9.

The circuit of the rib members on fixed collar assembly 7 is composed of two independent contacts, electric contact on fixed collar 721 and electric contact on fixed collar 722, which connect to power wire contact on fixed collar 341 of the electric wire 131 and power wire contact on fixed collar 342 of electric wire 132, respectively. Electric contact on fixed collar 721 and electric contact on fixed collar 722 will also connect to electric contact on slip ring 821 and electric contact on slip ring 822, respectively, creating a circuit switch.

LED assembly on slip ring 81 is composed of LED assembly on slip ring 811, LED assembly on slip ring 812 and LED assembly on slip ring 813, and is connected to illumination emitter of LED 4 via wire on slip ring 801, wire on slip ring 802, wire on slip ring 803 and wire on slip ring 804. Each LED assembly is formed by connecting the illumination emitter of LED 4 to a parallel circuit. The end point of wire on slip ring 801 is electric contact on slip ring 821, and the end point of wire on slip ring 802 is electric contact on slip ring 822. The two contacts are used to connect to electric contact on fixed collar 721 and electric contact on fixed collar 722, respectively, to for a circuit.

When the umbrella is closed, linkage members on slip ring assembly 8 is moved downwardly to the upper part of handle 14 and separated from rib members on fixed collar assembly 7, creating an open circuit. At this time, all the LED illumination components are not charged and do not light up. When the umbrella is opened, linkage members on slip ring assembly 8 is moved up to be fixed on the plate spring 111 on the shaft 11, making electric contact on fixed collar 721 and electric contact on fixed collar 722 to join together with electric contact on slip ring 821 and electric contact on slip ring 822, respectively, thus forming a complete circuit. When the pressing switch 12 is in a "closed" state, all the LED illumination components will be charged and light up.

FIG. 16(*b*) illustrates the circuit diagram used in the third embodiment of the present invention when integrated illumination components are used in a luminous umbrella. When the umbrella is opened and when the linkage members on slip ring assembly 8 and the rib members on fixed collar assembly 7 are fitted on the shaft 11 without direct contact with each other, switch assembly of fixed collar 79 is fixed on the shaft 11. Two independent contacts, electric contact of fixed ring switch 791 and electric contact of fixed ring switch 792, are fitted on the switch assembly of fixed collar 79. Power wire contact of fixed ring switch 793 of electric wire 131 and power wire contact of fixed ring switch 794 of electric wire 132 connect to the two previously-mentioned independent contacts, respectively. Electric contact of fixed ring switch 791 and electric contact of fixed ring switch 792 connect to electric contact on slip ring 821 and electric contact on slip ring 822, respectively, to form a circuit, replacing the circuit set on the rib members on fixed collar assembly 7. The wire contacts are to be in direct contact with those on the linkage members on slip ring assembly 8, constituting a complete circuit. When the umbrella is closed, the linkage members on slip ring assembly 8 slides down, the circuit is interrupted.

FIG. 17(*a*) illustrates the detailed structure of the illumination device used in the third embodiment of the present invention. The linkage members on slip ring assembly 8 and rib members on fixed collar assembly 7 are embodiments of the integrated illumination components of the present invention. The bases of the linkage members on slip ring assembly 8 and rib members on fixed collar assembly 7 are made of materials with high heat dissipation capability.

There are multiple slots on out surface of fixed collar of the rib members on fixed collar assembly 7, so fixed pins of ribs 171 can be used to fix the ribs 17. Electric contact on fixed collar 721 and electric contact on fixed collar 722 are fitted on the base of the rib members on fixed collar assembly 7. Power wire contact on fixed collar 341 of electric wire 131 and Power wire contact on fixed collar 342 of electric wire 132 connect to the two previously-mentioned independent contacts, respectively. The two contacts will be used as the circuit switch. Electric contact on fixed collar 721 and electric contact on fixed collar 722 are assembled directly on the bottom circumferential surface of fixed collar 764 with transparent package of LED assembly on fixed collar 75 being completed subsequently with transparent materials.

The distal end of shaft 11 is sealed with top column 16. Flexible canopy 10 is fixed with the rib members on fixed collar assembly 7 and is closely connected to top column 16 with fixed cover of flexible canopy 101 to prevent the rain from infiltrating into the inner section of umbrella.

There are multiple slots on out surface of slip ring of the linkage members on slip ring assembly 8, so the fixed pins of linkages 181 can be used to fix linkages 18. LED assembly on slip ring 81 can be further divided in to LED assembly on slip ring 811, LED assembly on slip ring 812 and LED assembly on slip ring 813. LED assembly on slip ring 813 is in stalled on the top circumferential surface of slip ring 861 beneath the canopy. LED assembly on slip ring 811 and LED assembly on slip ring 812 are installed on the bottom circumferential surface of slip ring 863.

The illumination emitter of LED 4 of LED assembly on slip ring 81 is connected with electric contact on slip ring 821 and electric contact on slip ring 822 via wire on slip ring 801, wire on slip ring 802, wire on slip ring 803 and wire on slip ring 804. It is also connected with electric contact on fixed collar 721 and electric contact on fixed collar 722. Therefore, the light originated from LED assembly on slip ring 813 will be projected to the inner section of the flexible canopy 10. Part of the light from LED assembly on slip ring 811 and LED assembly on slip ring 812 will be projected to the inner section of the flexible canopy 10, while part of light will be sent out in all directions under the umbrella.

LED assembly on slip ring 81 is assembled in advance or is directly assembled on the top circumferential surface of slip ring 861 and the bottom circumferential surface of slip ring 863 with trans parent package of LED assembly on slip ring 85 being completed subsequently with transparent materials, which can be further divided into the transparent package of LED assembly on slip ring 851 on the top circumferential surface of slip ring 861 and the transparent package of LED assembly on slip ring 852 on the bottom circumferential surface of slip ring 863. With the base of the linkage members on slip ring assembly 8 having good thermal conductivity and out surface of slip ring, including top circumferential surface of slip ring 861, middle circumferential surface of slip ring 862, bottom circumferential surface of slip ring 863 and holding surface of slip ring 864, as well as the slots offering heat dissipation function, the heat of LED assembly on slip ring 81 can be transmitted via these surfaces, thus lowering the temperature of transparent package of illumination semiconductor 41.

FIG. 17(*b*) illustrates another detailed structure of the illumination device used in the third embodiment of the pre sent invention. When the umbrella is opened and when the linkage members on slip ring assembly 8 and the rib members on fixed collar assembly 7 are fitted on the shaft 11 without direct contact with each other, switch assembly of fixed collar 79 is fixed on the shaft 11, whose base is made of materials with high heat dissipation capability.

Electric circuit and wire contacts are fitted on the switch assembly of fixed collar 79, replacing the circuit set on the rib members on fixed collar assembly 7. Two independent contacts, electric contact of fixed ring switch 791 and electric contact of fixed ring switch 792, are fitted on the circumferential surface on fixed ring switch 796 and are protected by the transparent resin package for fixed ring switch 795. Power wire contact of fixed ring switch 793 of electric wire 131 and power wire contact of fixed ring switch 794 of electric wire 132 connect to the two previously-mentioned independent contacts, respectively. Electric contact of fixed ring switch 791 and electric contact of fixed ring switch 792 connect to electric contact on slip ring 821 and electric contact on slip ring 822, respectively, to form a circuit, replacing the circuit set on the rib members on fixed collar assembly 7.

When the umbrella is opened, user pushes the linkage members on slip ring assembly 8 up along the shaft 11 to the position in which it can be tightly propped up by plate spring 111 and comes into close contact with the switch assembly of fixed collar 79, constituting a complete circuit. When the umbrella is closed, the plate spring 111 is loosened and the linkage members on slip ring assembly 8 slides down, creating an open circuit.

FIG. 18 illustrates the 3D detailed structure of the illumination device used in the third embodiment of the present invention. The figure presents that illumination emitters of LED 4 are placed on two annular surfaces, top circumferential surface of slip ring 861 and bottom circumferential surface of slip ring 863. Relative positions of electric contact on slip ring 821 and electric contact on slip ring 822 are to be considered at the same time. The light is able to illuminate every corner of inner canopy and the area under the flexible canopy 10. The number of illumination components and the angle of projection can also be adjusted according to different demands.

Actual installation of LED assembly on slip ring 81 for the linkage members on slip ring assembly 8 is described below. Wire on slip ring 801, wire on slip ring 802 and wire on slip ring 804 are fitted on top circumferential surface of slip ring 861 and are connected to the bottom circumferential surface of slip ring 863 via a hole for wire on slip ring (not shown). Wire on slip ring 801 of LED assembly on slip ring 813 connects to electric contact on slip ring 821. Wire on slip ring 802 of LED assembly on slip ring 811 connects to electric contact on slip ring 822. LED assembly on slip ring 813 and LED assembly on slip ring 812 are linked together with wire on slip ring 804. LED assembly on slip ring 811 and LED assembly on slip ring 812 are linked together with wire on slip ring 803.

The circumferential slots of slip ring 88, radial slots of slip ring 881 and radial slots of slip ring 882 are fitted on the middle circumferential surface of slip ring 862 to fix the ends of linkages 18. The slots offer the same heat dissipation function as heat dissipating fins do. The heat of LED assembly on slip ring 81 can be transmitted via these surfaces. The holding surface of slip ring 864 also offers additional space for heat dissipation, effectively lowering the temperature of transparent package of illumination semiconductor 41.

Two independent contacts, electric contact on fixed collar 721 and electric contact on fixed collar 722, are fitted on the rib members on fixed collar assembly 7. Electric wire 131 passes through the wall hole (not shown) of the shaft 11 via the central hole of the shaft 11, connecting with electric contact on fixed collar 721 at power wire contact on fixed collar 341. Electric wire 132 passes through the wall hole (not illustrated) of the shaft 11 via the central hole of the shaft 11, connecting with electric contact on fixed collar 722 at power wire contact on fixed collar 342. The rib members on fixed collar assembly 7 is fitted on the shaft 11 with pin hole 797.

Description of the Fourth Embodiment

FIG. 19 illustrates the structure of the fourth embodiment of the present invention when integrated illumination components are used in a luminous umbrella. A luminous umbrella 1 is composed of flexible canopy 10, shaft 11, plate spring 112, electric wire 13, handle 14, battery 151, top column 161, ribs 17 and linkages 18. Linkage members on slip ring assembly 2 and rib members on fixed collar assembly 3 are the integrated illumination components.

Plate spring 112 is fitted on the shaft 11. The handle 14 is fitted on the lower end of the shaft 11, and the linkage members on slip ring assembly 2 is installed on the upper end of the shaft 11. A hollow top column 161 is fitted on the distal end of the rib members on fixed collar assembly 3 to accommodate battery 151. There are holes (not shown) reserved for electric wire 13 (not shown) and wires of the illumination body. The ribs 17 are connected to linkages 18 with pivots, and the two parts are fixed with pivots on rib members on fixed collar assembly 3 and link age members on slip ring assembly 2, respectively.

Flexible canopy 10 is fled on the ribs 17. The umbrella can be opened and closed via the upward and downward sliding of linkage members on slip ring assembly 2 along the shaft 11. Linkage members on slip ring assembly 2 and rib members on fixed collar assembly 3 constitute a set of circuit switch.

When the umbrella is opened, linkage members on slip ring assembly 2 is propped up by the close position of plate spring 1122 (not shown) of plate spring 112, allowing the umbrella to remain open. At this time, the circuit switch is in a "closed" state, and the LED illumination device will light up. The illumination emitters of LED 4 on linkage members on slip ring assembly 2 and rib members on fixed collar assembly 3 will illuminate the inner section of flexible canopy 10. Although the umbrella is opened, the linkage members on slip ring assembly 2 is propped up by the open position of plate spring 1121 (not shown) of plate spring 112, allowing the umbrella to remain open. At this time, the circuit switch is in a "opened" state, and the LED illumination device will not light up. If the umbrella is to be used in a fixed location and for a long period of time, external power source, instead of batteries, can be adopted.

FIG. 20 illustrates the circuit diagram used in the fourth embodiment of the present invention. The diagram presents the required electric circuit for installing the illumination emitter of LED 4. All the electric components referred to in the diagram meet the necessary electric insulation and safety requirements. The two-core electric wire 13 is composed of electric wire 131 and electric wire 132 and is used to form a circuit for connection with battery 15, linkage members on slip ring assembly 2 and rib members on fixed collar assembly 3.

LED assembly on slip ring 21 is composed of LED assembly on slip ring 211 and LED assembly on slip ring 212, all of which are linked with wire on slip ring 201, wire on slip ring 202 and wire on slip ring 203. LED assembly on slip ring 211 and LED assembly on slip ring 212 are created with parallel circuit connecting to the illumination emitter of LED 4. The end point of wire on slip ring 202 is electric contact on slip ring 22, and the end point of wire on slip ring 201 is electric contact on slip ring 23. The two contacts are used to connect with electric contact on fixed collar 32 and electric contact on fixed collar 33, respectively, to form a circuit.

LED assembly on fixed collar 31 is composed of electric wire on fixed collar 301, electric wire on fixed collar 303 and the illumination emitter of LED with the former two connecting to the illumination emitter of LED in respective parallel circuits. The end point of electric wire on fixed collar 303 is electric contact on fixed collar 33. The end point of electric wire on fixed collar 301 is power wire contact on fixed collar 341, which connects to electric wire 131. Electric wire on fixed collar 302 is an independent wire, of which one end point is power wire contact on fixed collar 342, connecting to electric wire 132, and the other end point is electric contact on fixed collar 32.

When the umbrella is closed, linkage members on slip ring assembly 2 is moved downwardly to the upper part of handle 14 and separated from rib members on fixed collar assembly 3, creating an open circuit. At this time, all the LED illumination components are not charged and do not light up.

When the umbrella is opened, linkage members on slip ring assembly 2 is moved up to be fixed in the open position of plate spring 1121 of plate spring 112 on the shaft 11, creating a gap between electric contact on fixed collar 33 and electric contact on slip ring 23 as well as between electric contact on fixed collar 32 and electric contact on slip ring 22, respectively. The circuit remains open. All the LED illumination components are not charged and do not light up.

When the umbrella is opened, linkage members on slip ring assembly 2 is moved up to be fixed in the close position of plate spring 1122 of plate spring 112 on the shaft 11, ma king electric contact on fixed collar 33 and electric contact on fixed collar 32 to join together with electric contact on slip ring 23 and electric contact on slip ring 22, respectively, thus forming a closed circuit. All the LED illumination components will be charged and light up.

FIG. 21(*a*) and FIG. 21(*b*) illustrate the detailed structure of the illumination device used in the fourth embodiment of the present invention. The linkage members on slip ring assembly 2 and rib members on fixed collar assembly 3 are embodiments of the integrated illumination components of the present invention. The bases of the linkage members on slip ring assembly 2 and rib members on fixed collar assembly 3 are made of materials with high heat dissipation capability.

There are multiple slots on out surface of slip ring 26 of the linkage members on slip ring assembly 2. Fixed pins of linkages 181 are used to fix linkages 18. LED assembly on slip ring 21 is fitted on top circumferential surface of slip ring 264 (n of shown) and can be further divided into LED assembly on slip ring 211 and LED assembly on slip ring 212, connecting to electric contact on slip ring 22 and electric contact on slip ring 23, respectively. LED assembly on slip ring 21 is assembled in advance or is directly assembled on the base with transparent package of LED assembly on slip ring 25 being completed subsequently with transparent materials. The heat of LED assembly on slip ring 21 is transmitted via the base of great heat transfer capability and through the out surf ace of slip ring 26 as well as multiple slots to the atmosphere in order to lower the temperature of transparent package of illumination semiconductor 41.

There are multiple annular surfaces of different diameters on out surface of fixed collar 36 of the rib members on fixed collar assembly 3. A plurality of slots are fitted on one of the annular surface, on which fixed pins of ribs 171 are used to fix the ribs 17. The rib members on fixed collar assembly 3 is fitted on the distal end of the shaft 11, whose top circumferential surface of fixed collar 365 is stretched up through flexible canopy 10 and combined closely with fixed cover of flexible canopy 102 to prevent the rain from infiltrating into the inner section of umbrella.

The hollow top column 161 is installed on the upward stretched section of the rib members on fixed collar assembly 3, located in the hole of top circumferential surface of fixed collar 365, and is used to accommodate battery 151, electric wire and holder of battery 152. Holder of battery 152 is fitted with the battery positive and negative contacts, which are used to connect with power wire contact on fixed collar 341 and power wire contact on fixed collar 342.

Spring 162 is installed inside the hollow top column 161 to make sure the battery is securely fixed. LED assembly on fixed collar 31 is fitted on the bottom circumferential surface of fixed collar 362 (not shown), connecting to electric contact on fixed collar 32 and electric contact on fixed collar 33, respectively. LED assembly on fixed collar 31 is assembled in advance or is directly assembled on the base with transparent package of LED assembly on fixed collar 35 being completed subsequently with transparent materials.

LED assembly on fixed collar 31 connects with electric wire 131 and electric wire 132 at power wire contact on fixed collar 341 and power wire contact on fixed collar 342, respectively. The circuit is made complete by electric wire on fixed collar 301 and electric wire on fixed collar 302, which pass through the hole (not shown) on the base of shaft 11 to be welded to electric wire 131 (not shown) and electric wire 132 (not shown) at power wire contact on fixed collar 341 and power wire contact on fixed collar 342 on the top of the shaft. With the rib members on fixed collar assembly 3 having good thermal conductivity and the out surface of fixed collar 36 as well as the slots offering heat dissipation function, the heat of LED assembly on fixed collar 31 can be transmitted via these surfaces, thus lowering the temperature of transparent package of illumination semiconductor 41.

When the umbrella is opened, linkage members on slip ring assembly 2 are moved up to be fixed in the open position of plate spring 112 on the shaft 11. The open position of plate spring 1121 is fixed in the open slot of slip ring 283, making electric contact on fixed collar 33 and electric contact on fixed collar 32 closer to the electric contact on slip ring 23 and electric contact on slip ring 22, respectively, without direct contact. The circuit thus remains open. All the LED illumination components are not charged and do not light up.

As shown in FIG. 21(*a*), when the umbrella is opened, linkage members on slip ring assembly 2 is moved up to be fixed in the close position of plate spring 112 on the shaft 11. The close position of plate spring 1122 is fixed in the open slot of slip ring 283, making electric contact on fixed collar 33 and electric contact on fixed collar 32 to join together with electric contact on slip ring 23 and electric contact on slip ring 22, respectively, thus forming a closed circuit. All the LED illumination components will be charged and light up.

As shown in FIG. 21(*b*), the embodiment is very suitable for usage at rainy days. By controlling the location setting of wire contacts for the circuit switch, power can be saved for umbrella when used in the daytime. Pressing switch 12 and long electric wire 13 can also be removed, so additional switch as seen in Reference Six and Reference Nine is not needed at all.

In summary, the versatility and design flexibility of the integrated illumination components of the present invention can be found in the above mentioned embodiments, which also present feasibility and significant improvements to currently known technical problems. More embodiments are expected to be discovered and realized. In addition, installation of the illumination emitter of LED for the integrated illumination components is highly flexible. While offering warning and safety functions, the illumination feature can also be used for color decoration and aesthetic expression together with the semi-transparent canopy and color LED illumination components. Utilizing umbrella parts of high heat dissipation capability as bases makes it more convenient for de signers and users to adopt the high-brightness LED illumination components and easier to meet their needs.

BRIEF DESCRIPTION OF THE DRAWINGS

FIG. 4(*b*) illustrates another detailed structure of the umbrella handle illumination assembly of the present invention.

FIG. 7(*b*) illustrates the 3D detailed structure of the base of linkage members on slip ring assembly used in the first embodiment of the present invention.

FIG. 10(*b*) illustrates structure of the luminous umbrella constructed in accordance with the second embodiment of the present invention. The central ring assembly is in direct contact with rib members on fixed collar assembly.

FIG. 11(*b*) illustrates the circuit diagram used in the second embodiment of the present invention. The central ring assembly is in direct contact with rib members on fixed collar assembly.

FIG. 12(*b*) illustrates the detailed structure of the illumination device used in the second embodiment of the present invention. The central ring assembly is in direct contact with rib members on fixed collar assembly.

FIG. 15(*b*) illustrates structure of the luminous umbrella constructed in accordance with the third embodiment of the present invention. The central ring assembly is in direct contact with linkage members on slip ring assembly.

FIG. 16(*b*) illustrates the circuit diagram used in the third embodiment of the present invention. The central ring assembly is in direct contact with linkage members on slip ring assembly.

FIG. 17(*b*) illustrates the detailed structure of the illumination device used in the second embodiment of the present invention. The central ring assembly is in direct contact with linkage members on slip ring assembly.

FIG. 21(*b*) illustrates the detailed structure of the illumination device used in the fourth embodiment of the present invention. The umbrella is opened with a closed circuit. The illumination emitter of LED lights up.

SYMBOLS OF MAIN ELEMENTS

Figure 1:
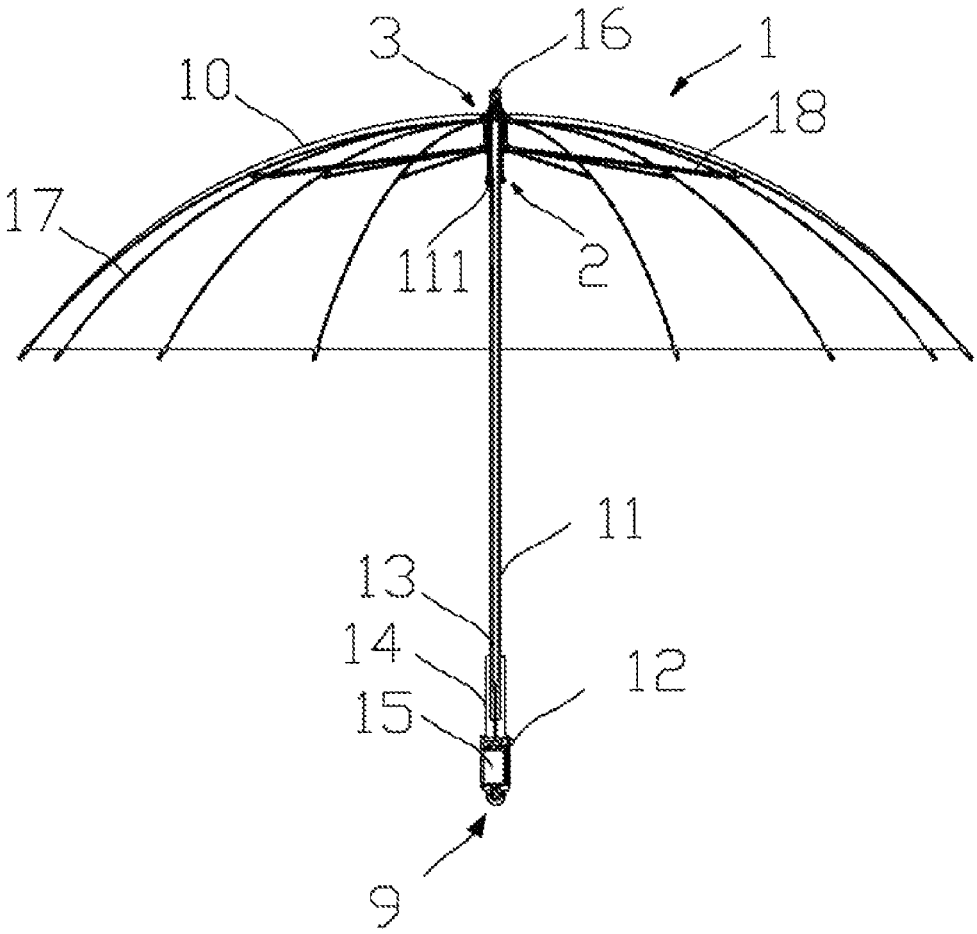
FIG. 1 illustrates structure of the luminous umbrella constructed in accordance with the first embodiment of the present invention.
Figure 2:
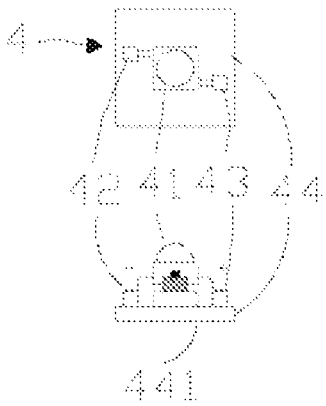
FIG. 2 illustrates the structure of the illumination emitter of LED used in the present invention.
Figure 3:
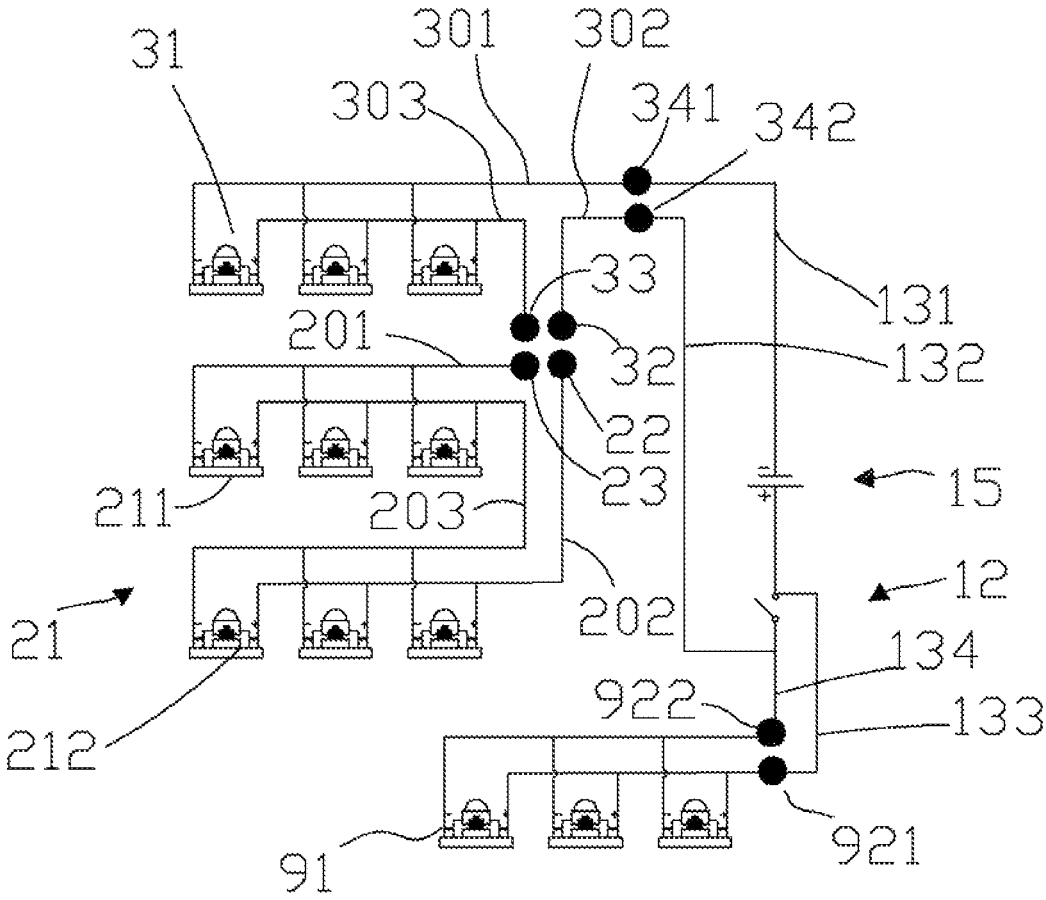
FIG. 3 illustrates the circuit diagram used in the first embodiment of the present invention.
Figure 4A:
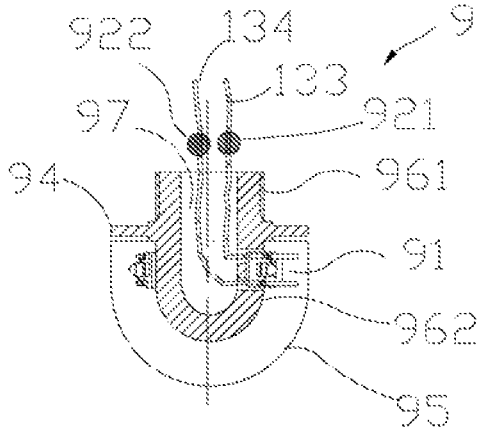
FIG. 4(*a*) illustrates the detailed structure of the umbrella handle illumination assembly of the present invention.
Figure 4B:
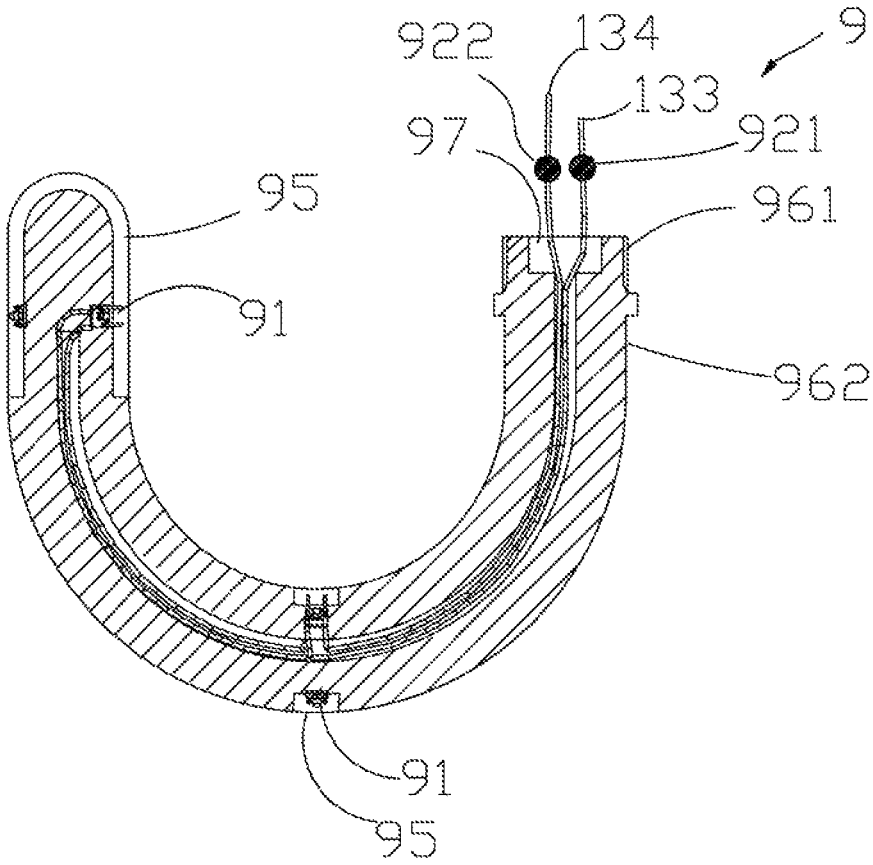
Figure 5:
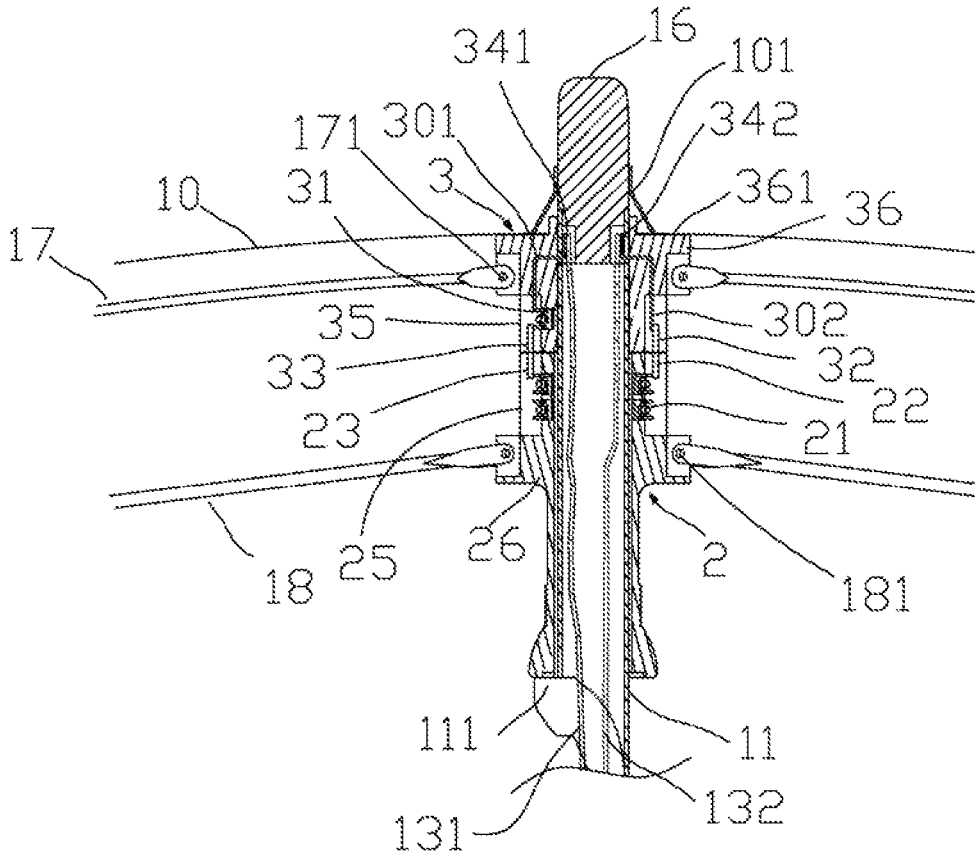
FIG. 5 illustrates the detailed structure of the illumination device used in the first embodiment of the present invention.
Figure 6:
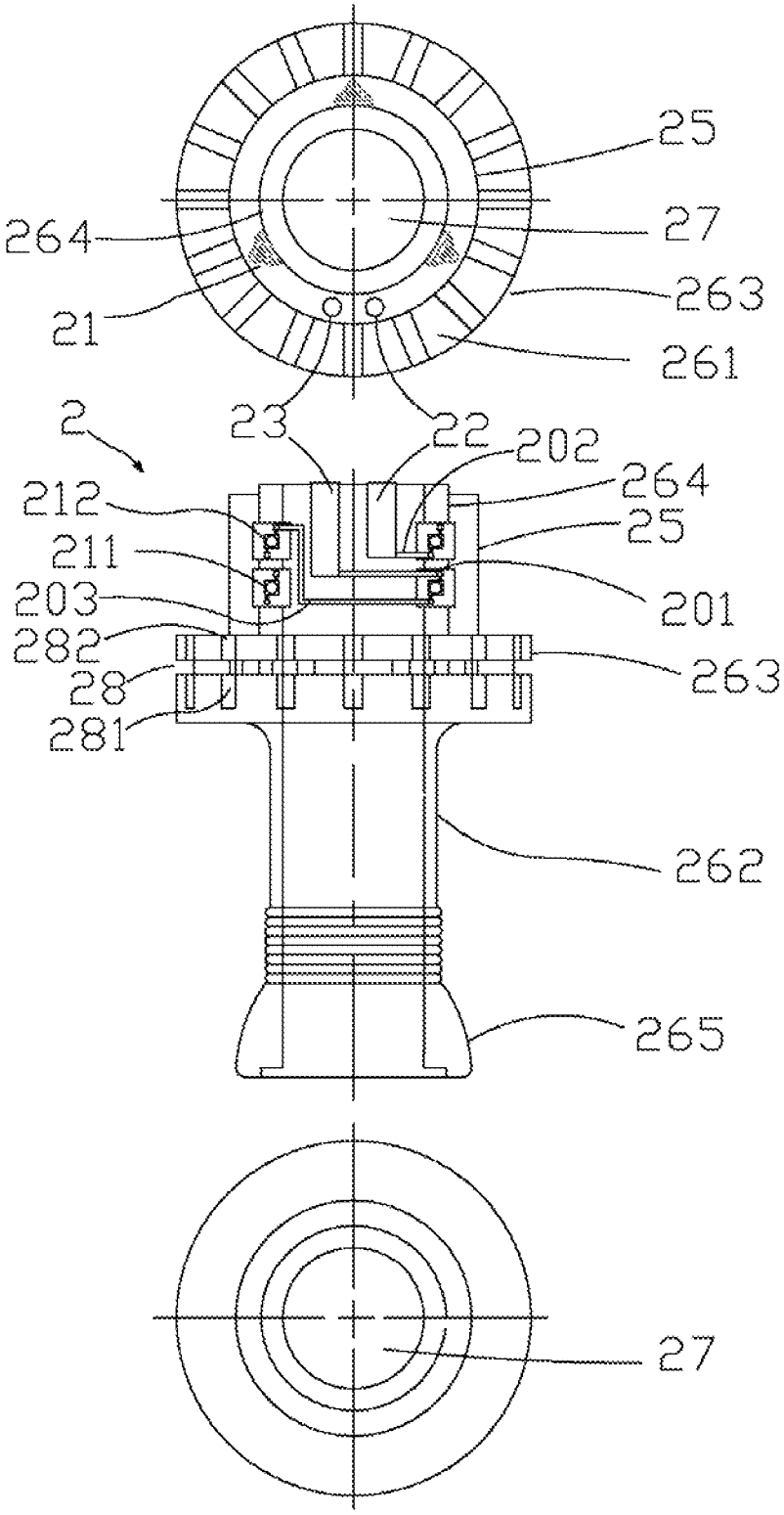
FIG. 6 illustrates the detailed structure of the LED illumination device of linkage members on slip ring assembly used in the first embodiment of the present invention.
Figure 7A:
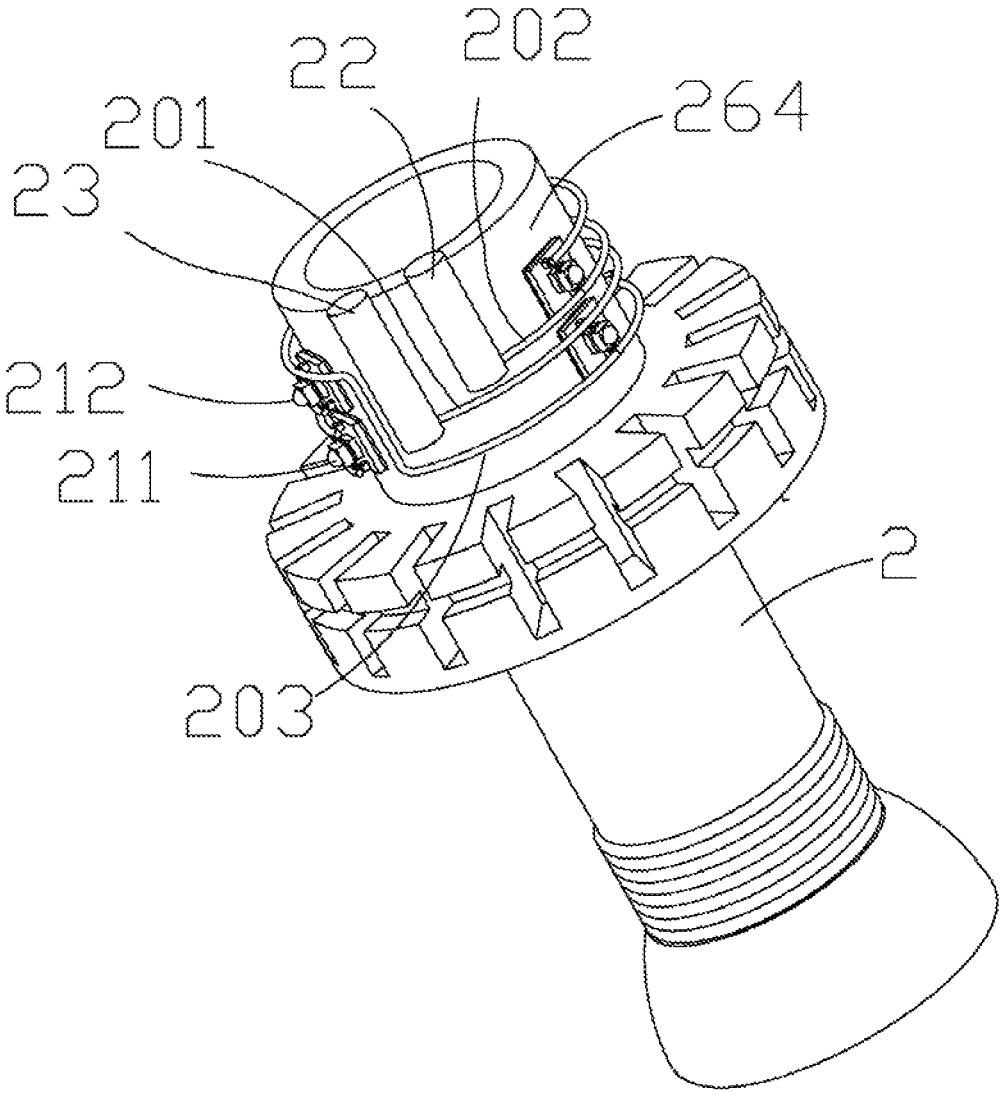
FIG. 7(*a*) illustrates the 3D detailed structure of linkage members on slip ring assembly used in the first embodiment of the present invention.
Figure 7B:
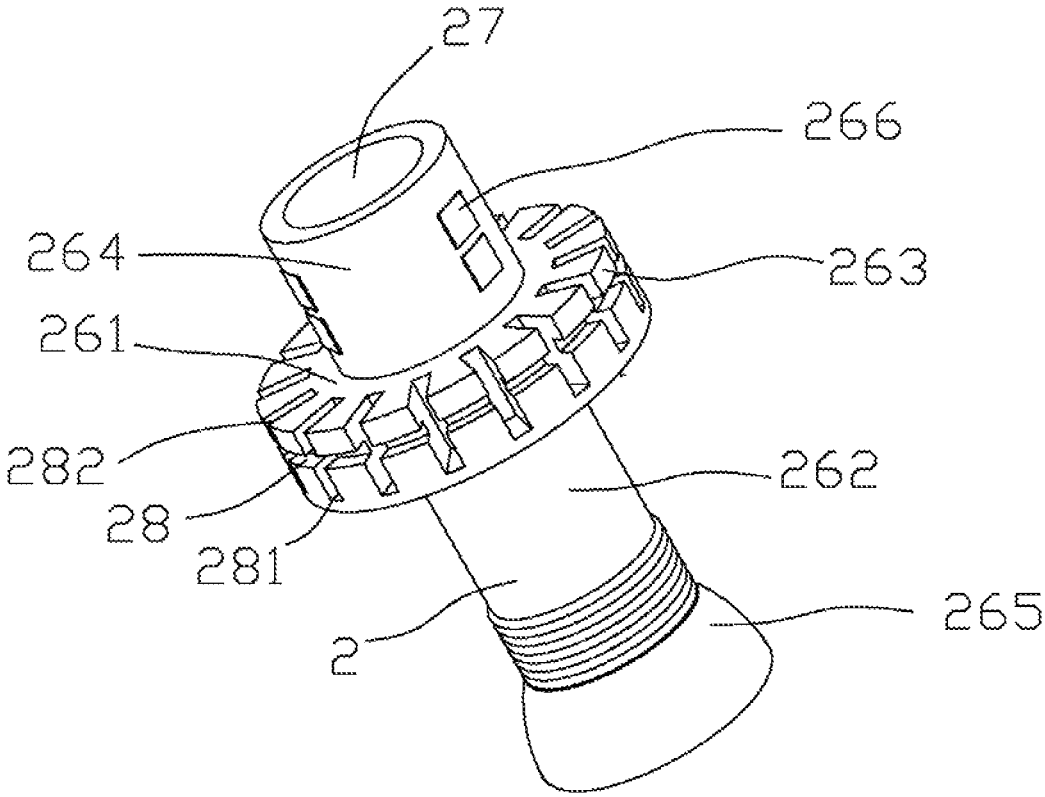
Figure 8:
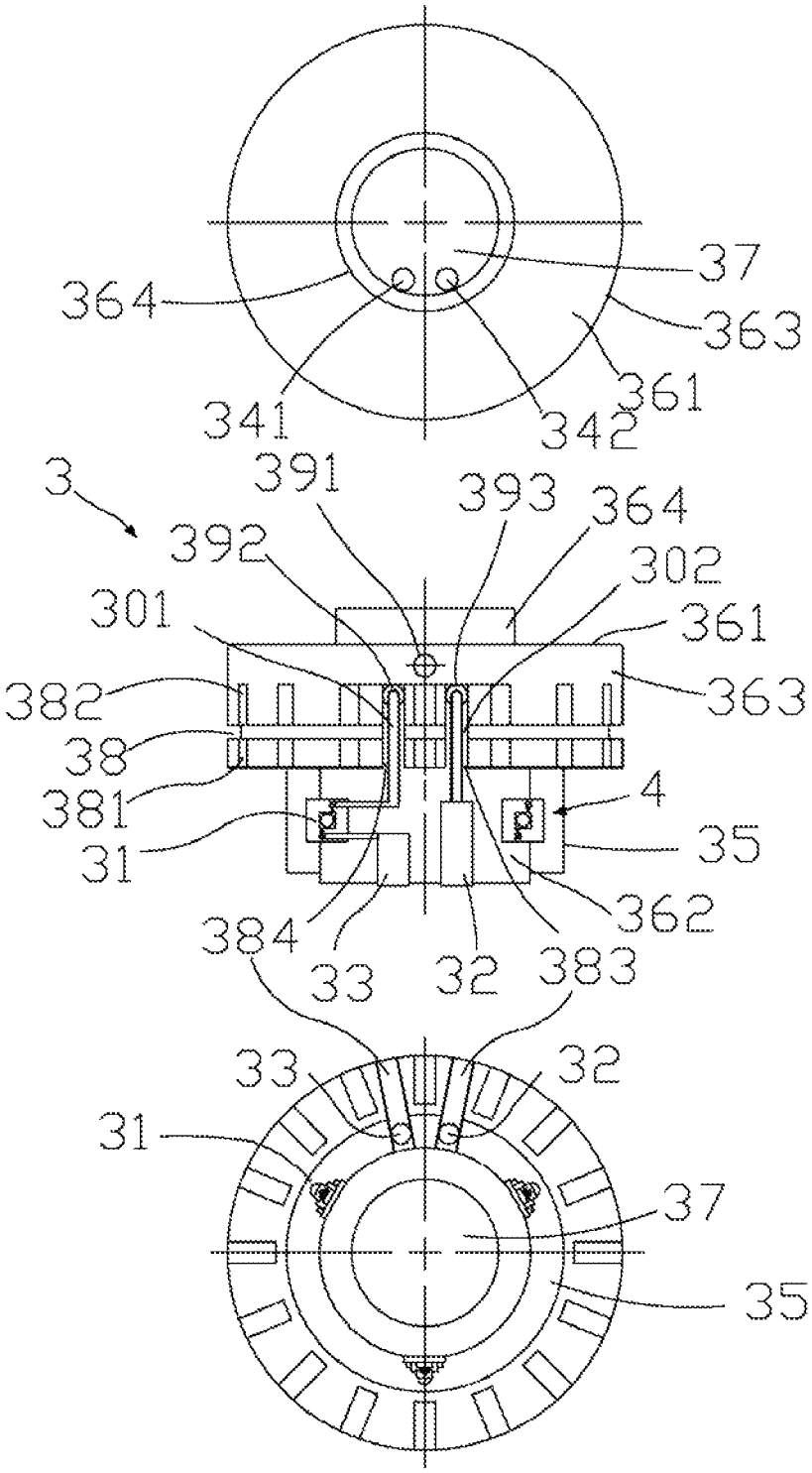
FIG. 8 illustrates the detailed structure of rib members on fixed collar assembly used in the first embodiment of the present invention.
Figure 9:
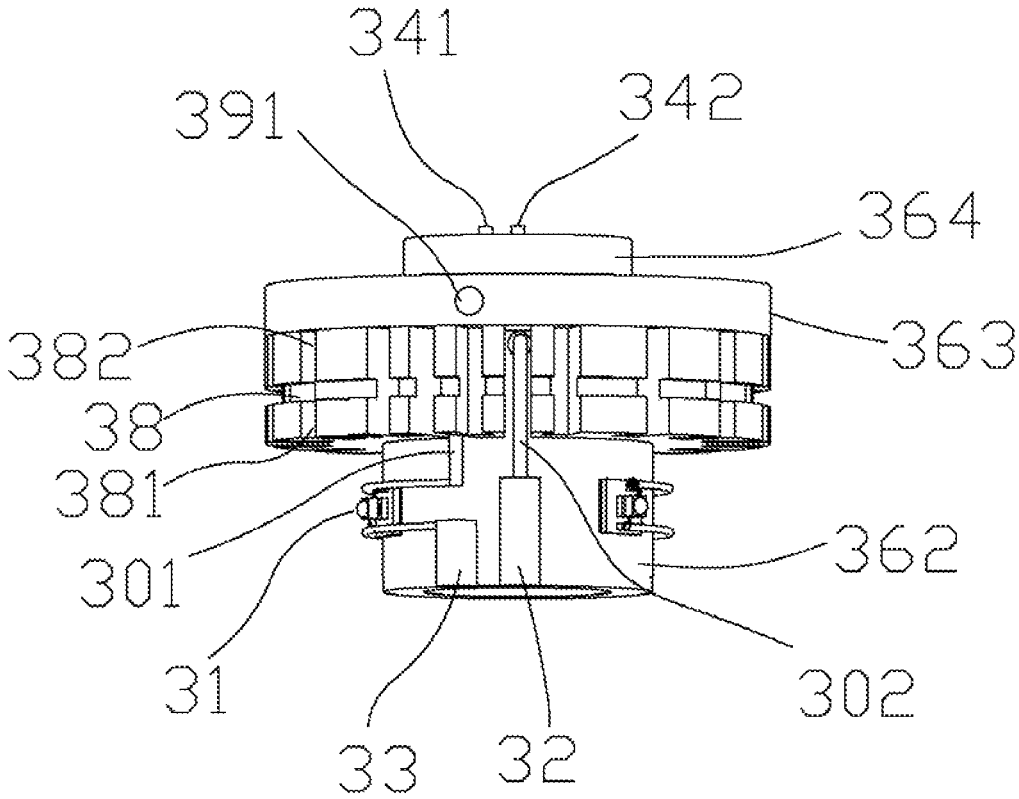
FIG. 9 illustrates the 3D detailed structure of rib members on fixed collar assembly used in the first embodiment of the present invention.
Figure 10A:
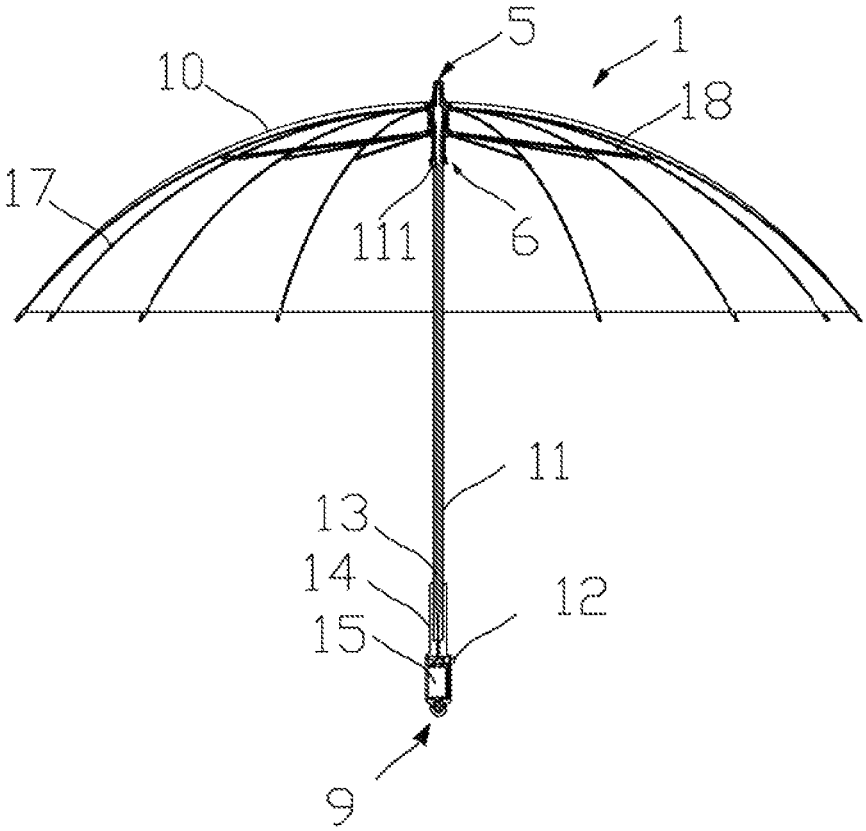
FIG. 10(*a*) illustrates structure of the luminous umbrella constructed in accordance with the second embodiment of the present invention.
Figure 10B:
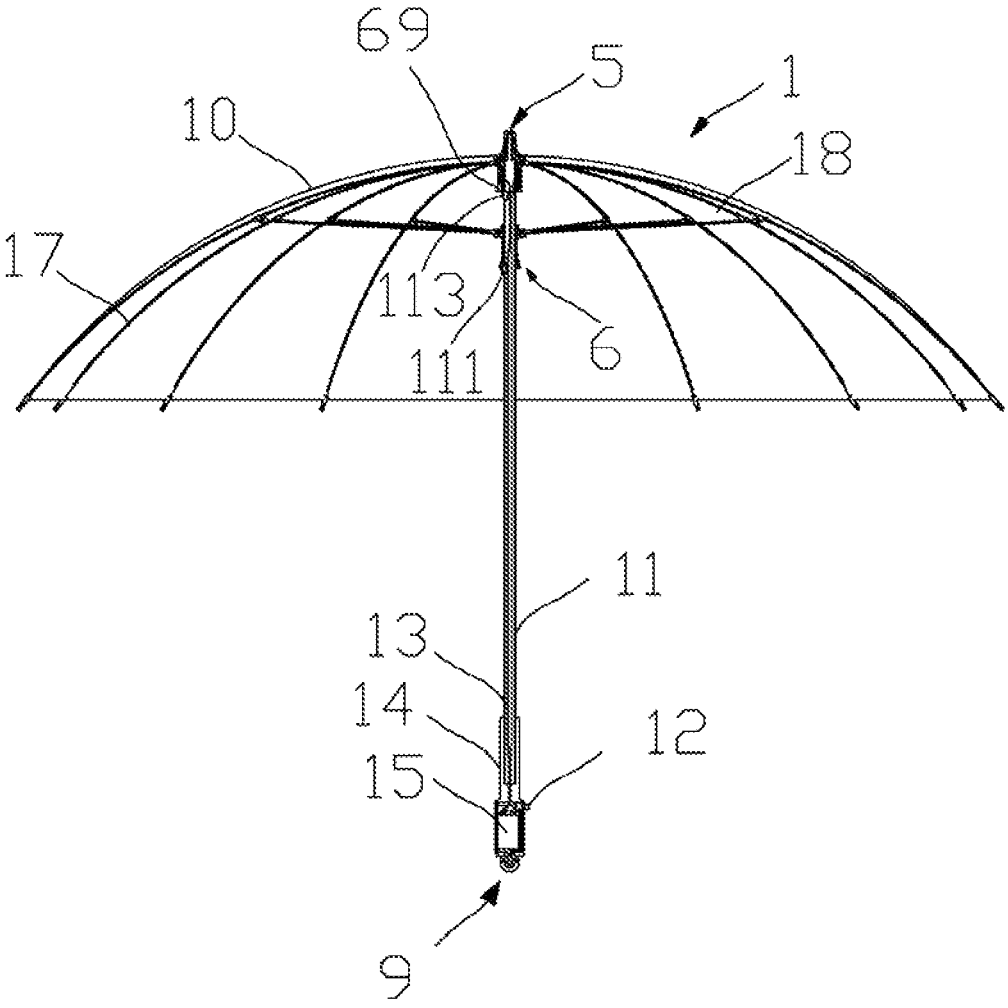
Figure 11A:
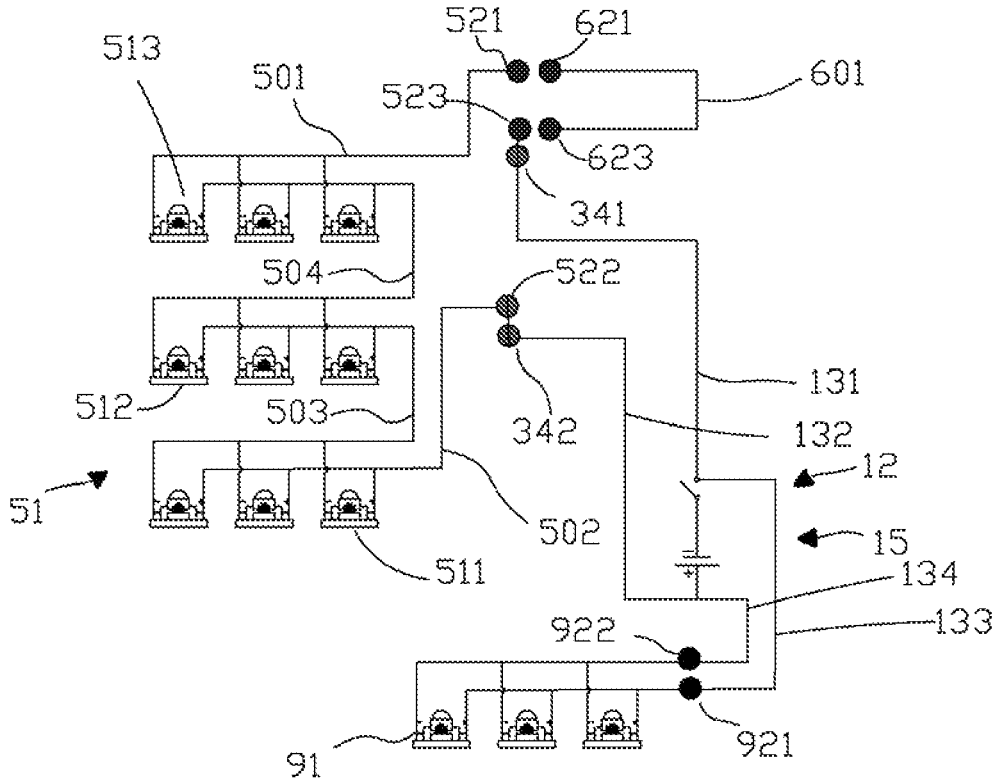
FIG. 11(*a*) illustrates the circuit diagram used in the second embodiment of the present invention.
Figure 11B:
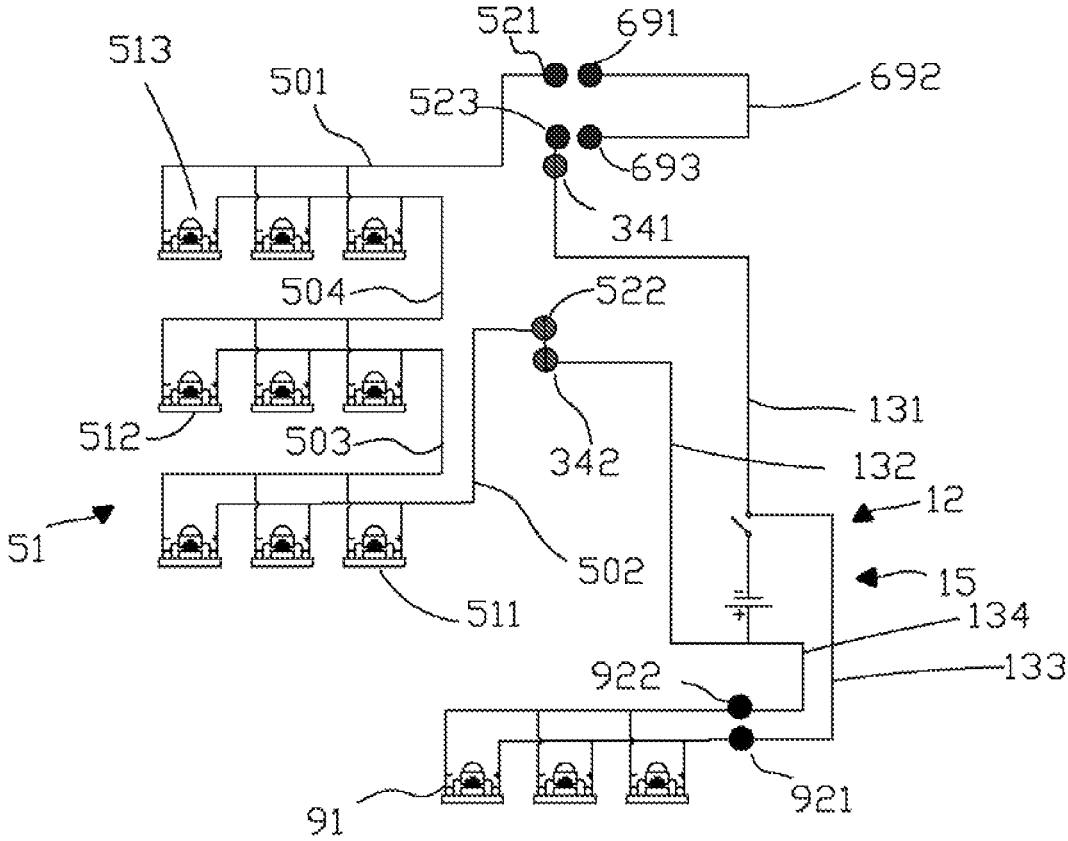
Figure 12A:
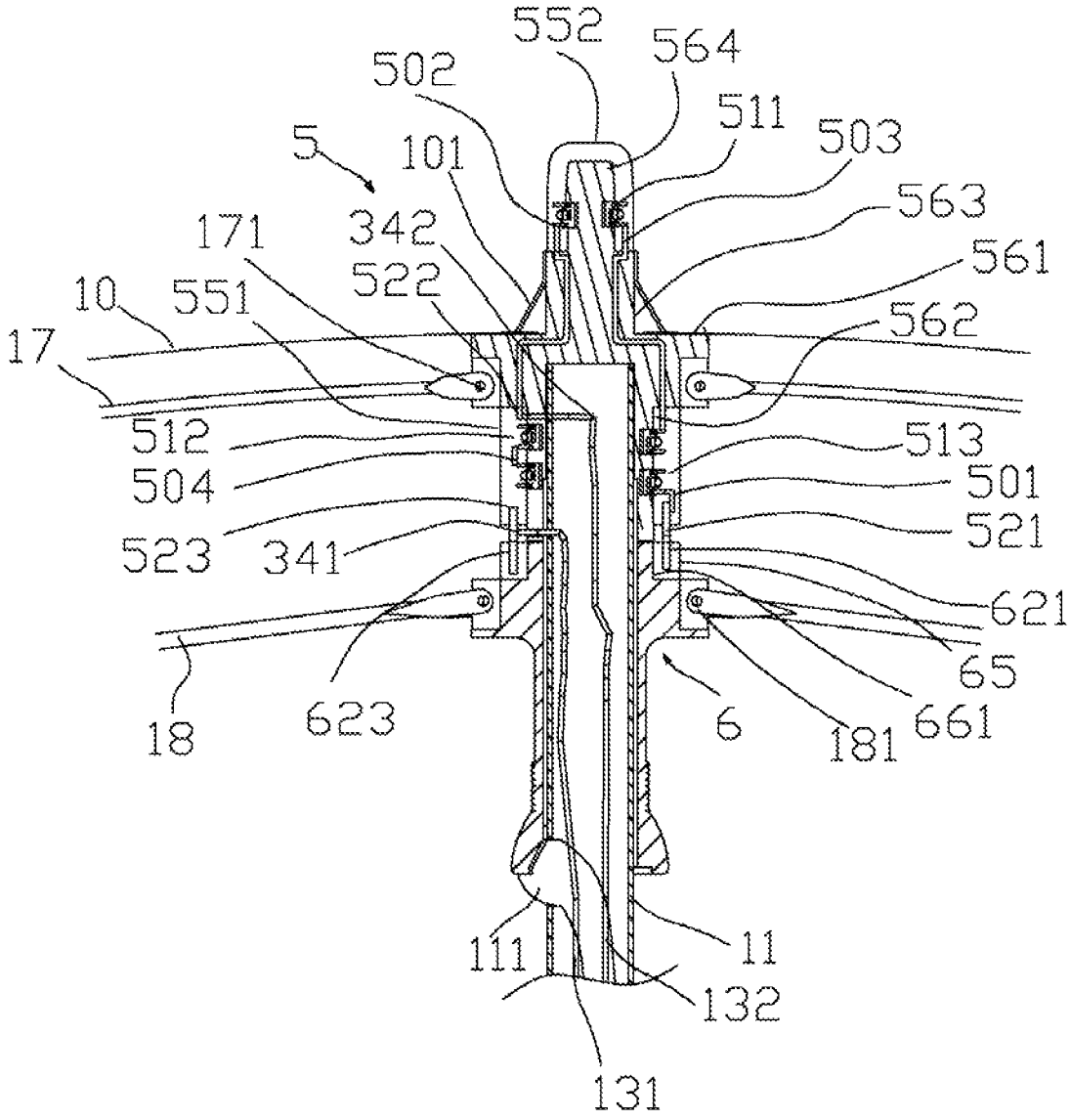
FIG. 12(*a*) illustrates the detailed structure of the illumination device used in the second embodiment of the present invention.
Figure 12B:
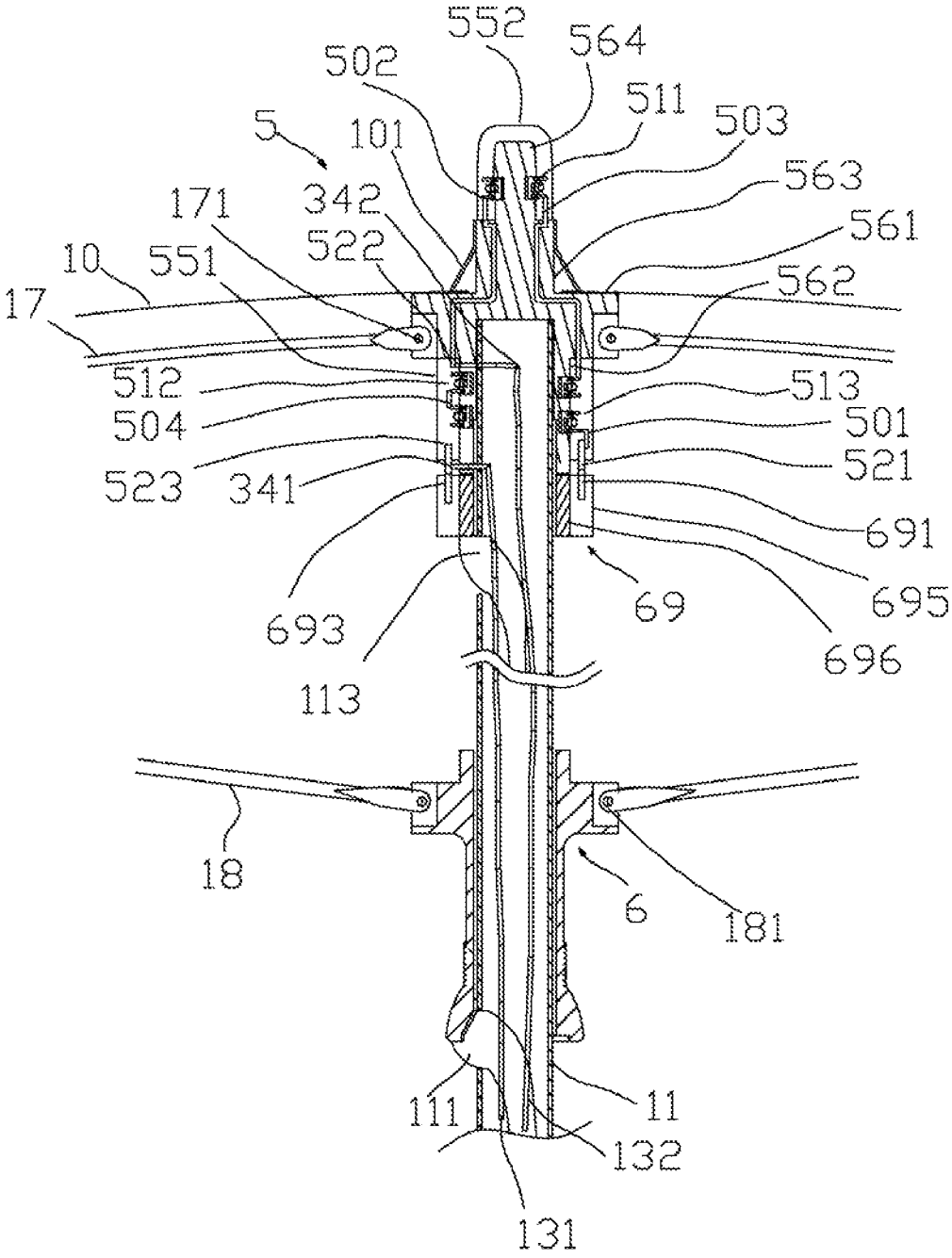
Figure 13:
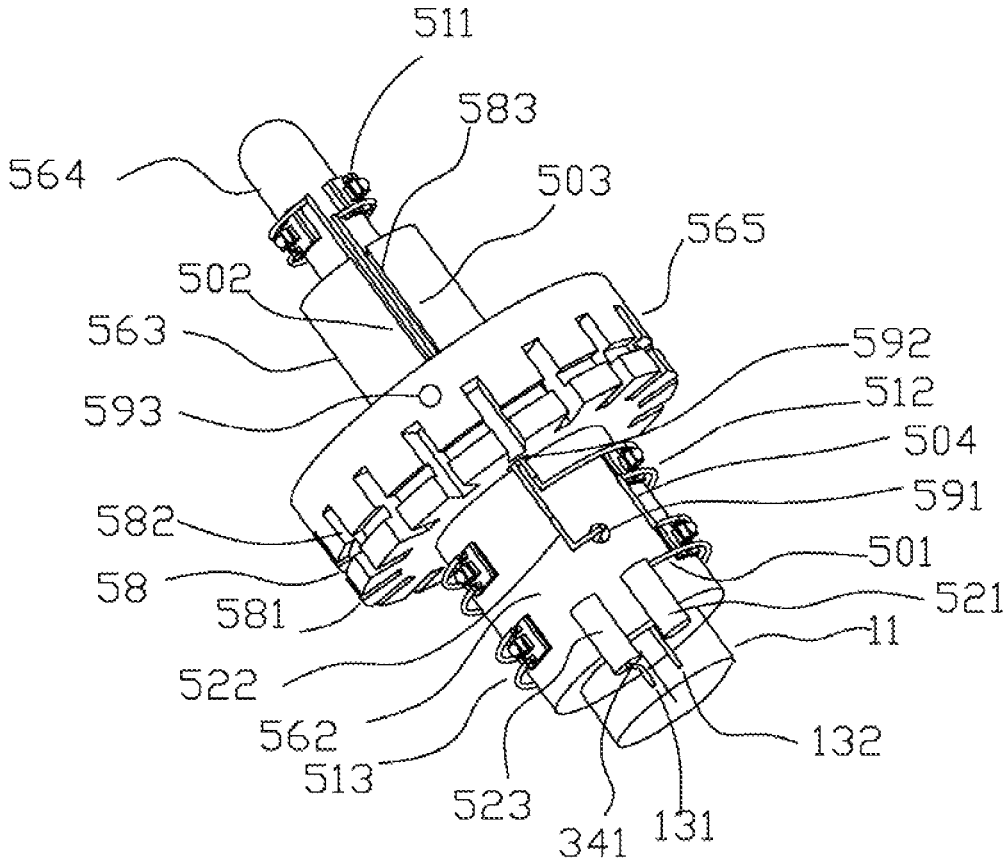
FIG. 13 illustrates the 3D detailed structure of rib members on fixed collar assembly used in the second embodiment of the present invention.
Figure 14:
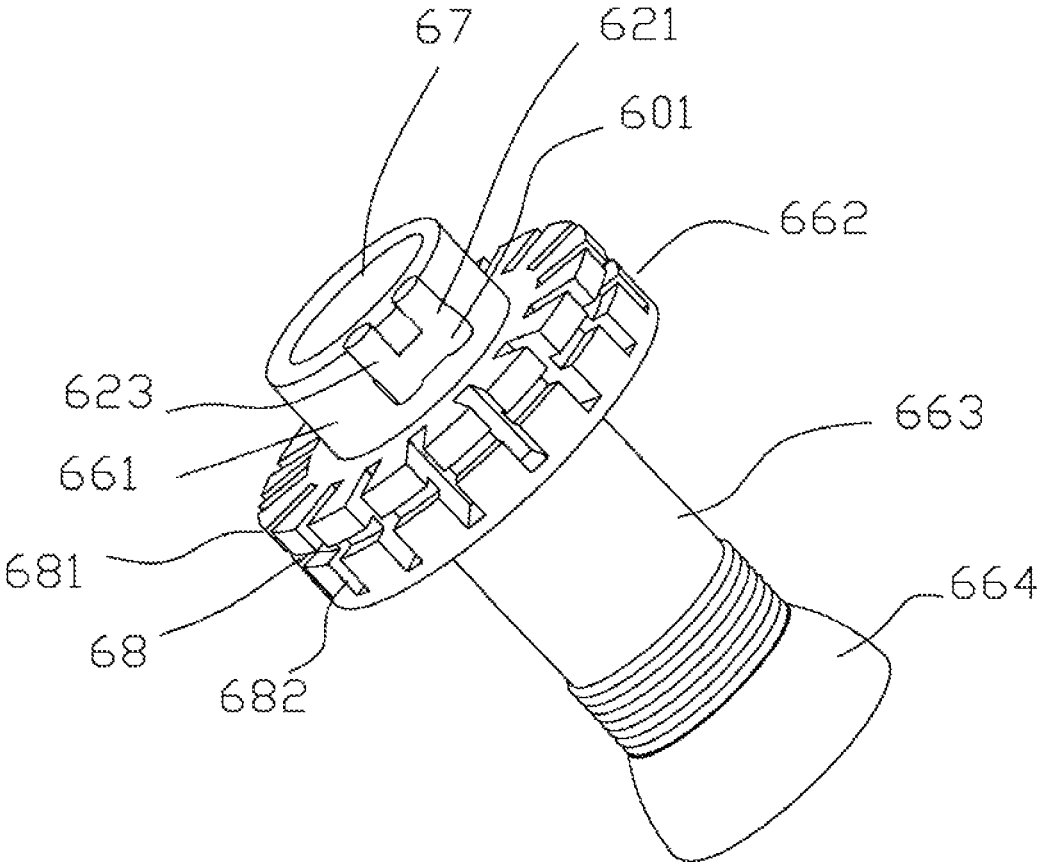
FIG. 14 illustrates the 3 D detailed structure of linkage members on slip ring assembly used in the second embodiment of the present invention.
Figure 15A:
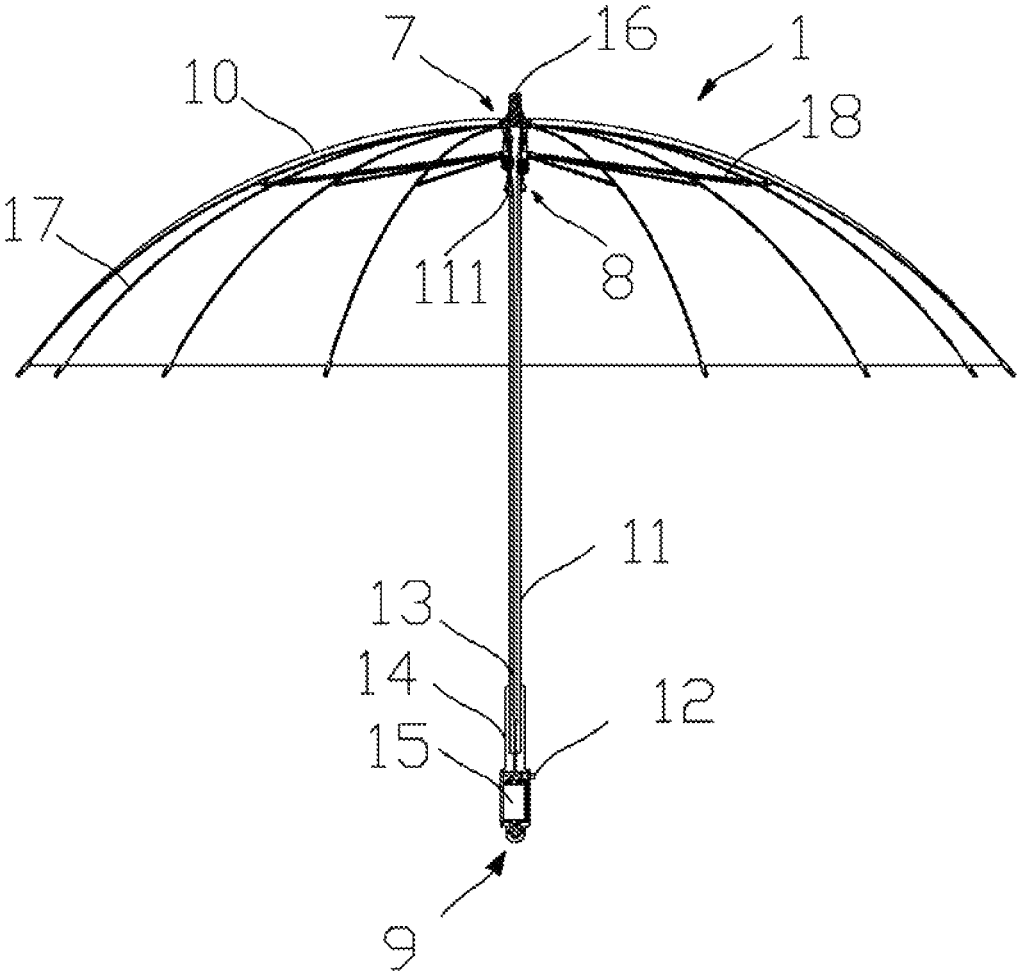
FIG. 15(*a*) illustrates structure of the luminous umbrella constructed in accordance with the third embodiment of the present invention.
Figure 15B:
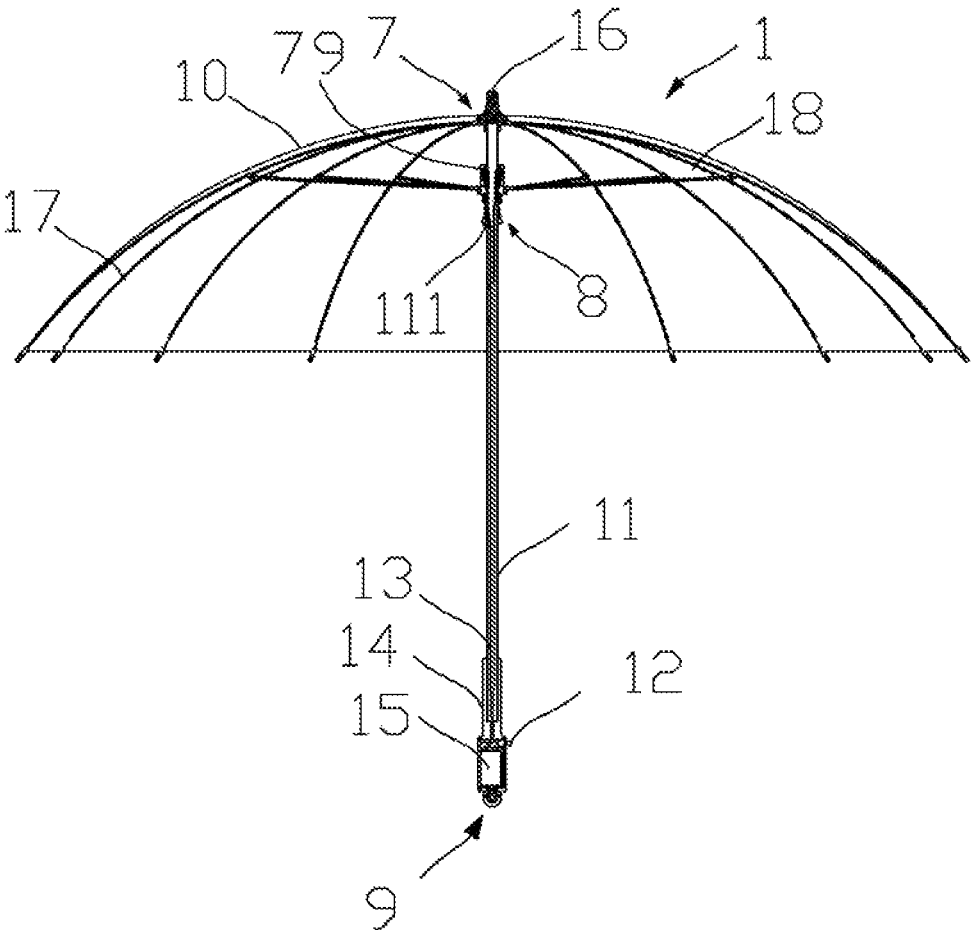
Figure 16A:
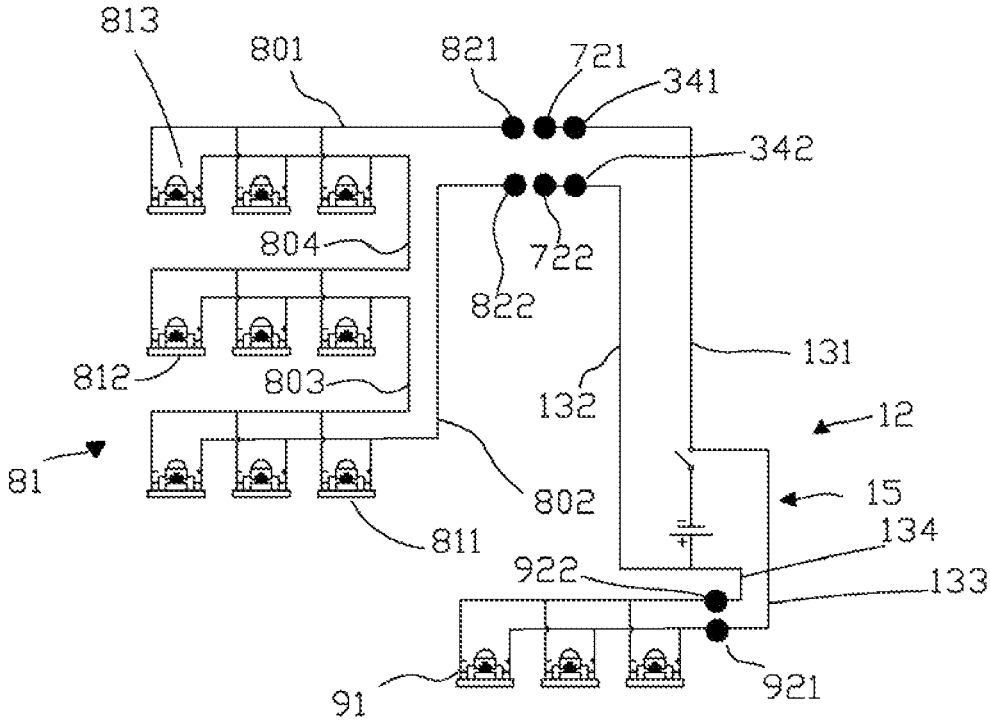
FIG. 16(*a*) illustrates the circuit diagram used in the third embodiment of the present invention.
Figure 16B:
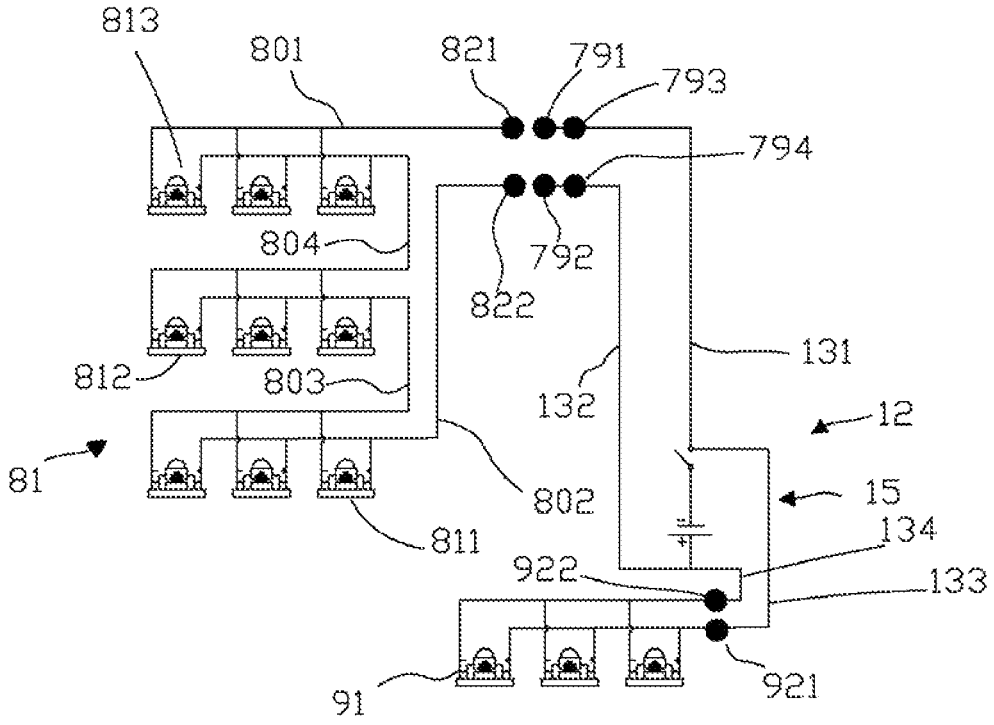
Figure 17A:
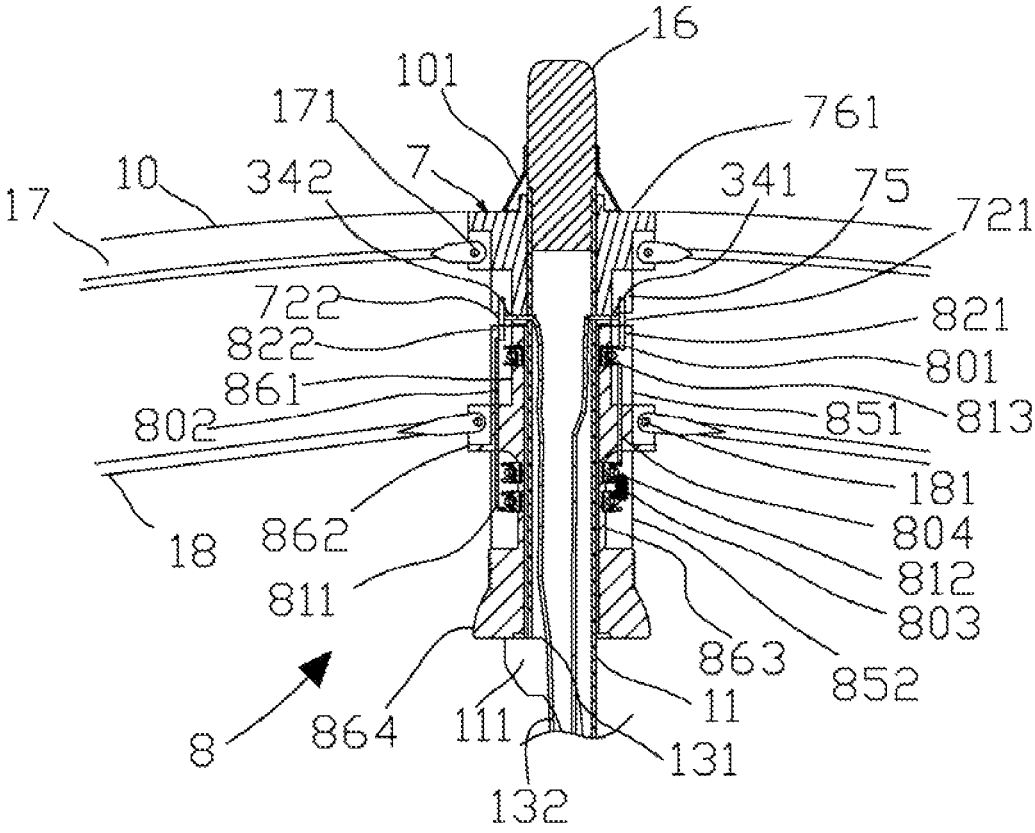
FIG. 17(*a*) illustrates the detailed structure of the illumination device used in the third embodiment of the present invention.
Figure 17B:
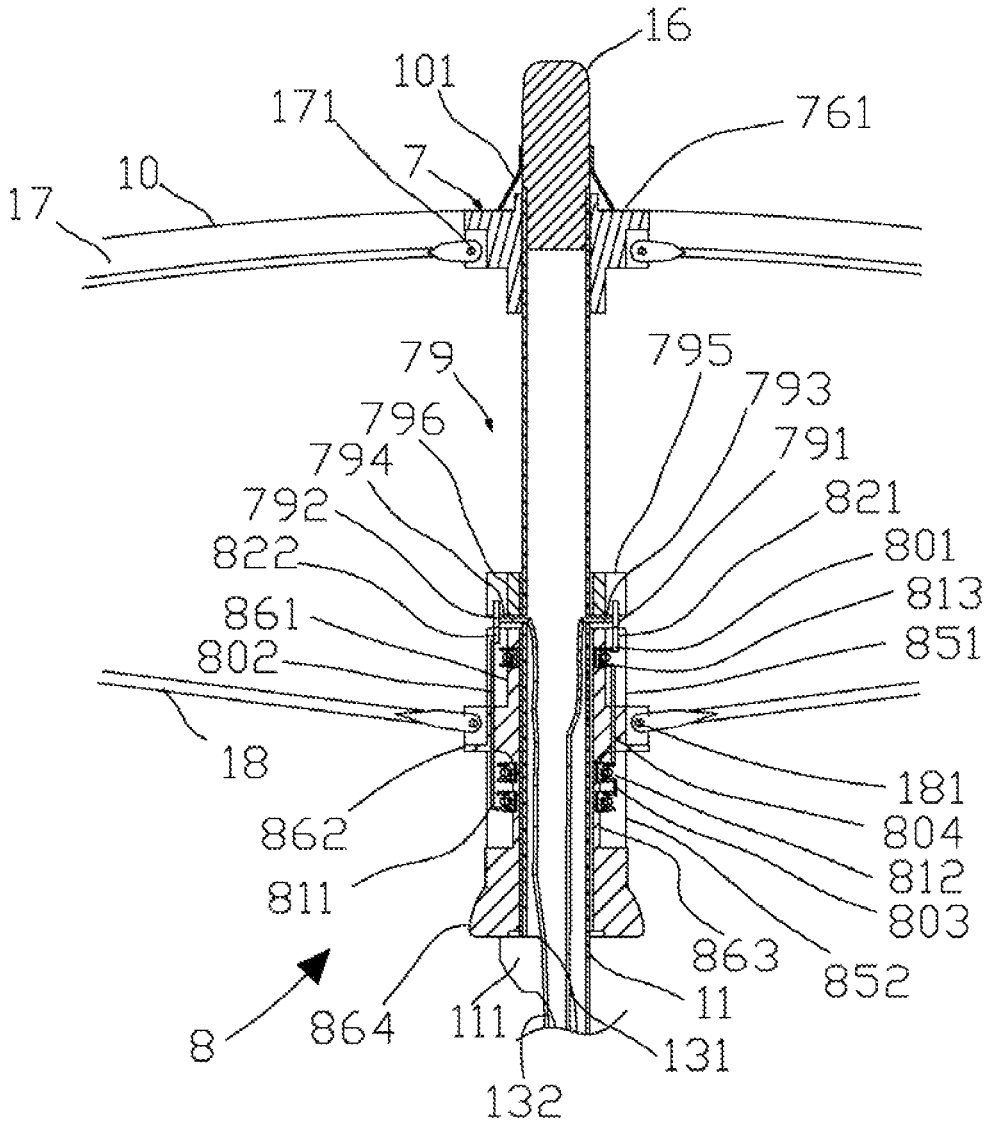
Figure 18:
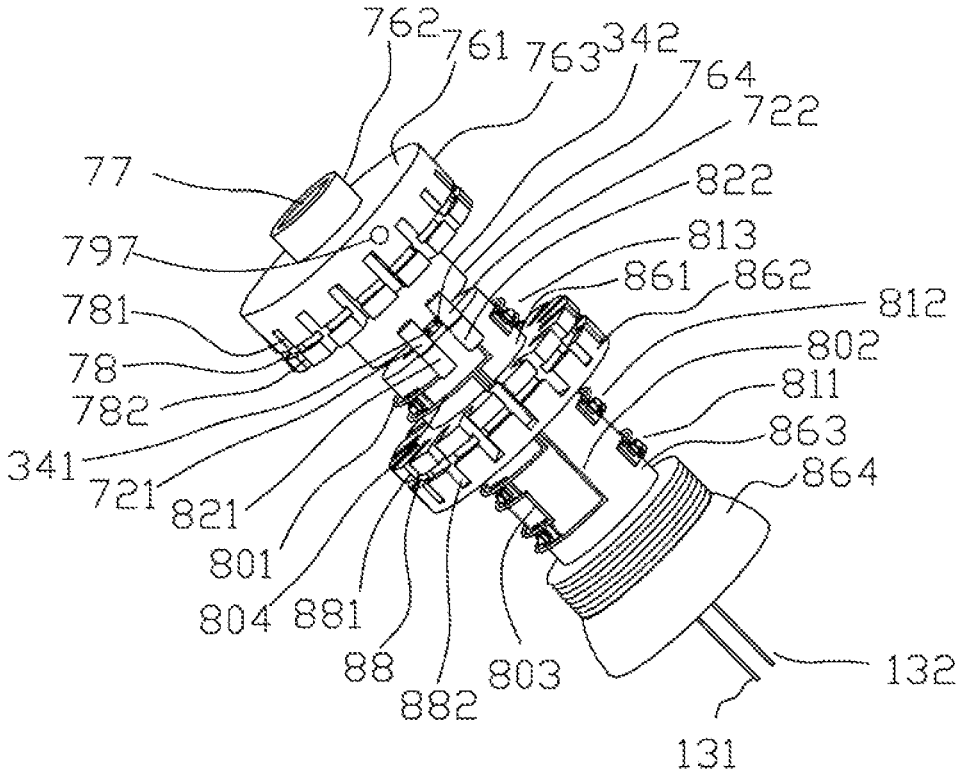
FIG. 18 illustrates the 3D detailed structure of the illumination device used in the third embodiment of the present invention.
Figure 19:
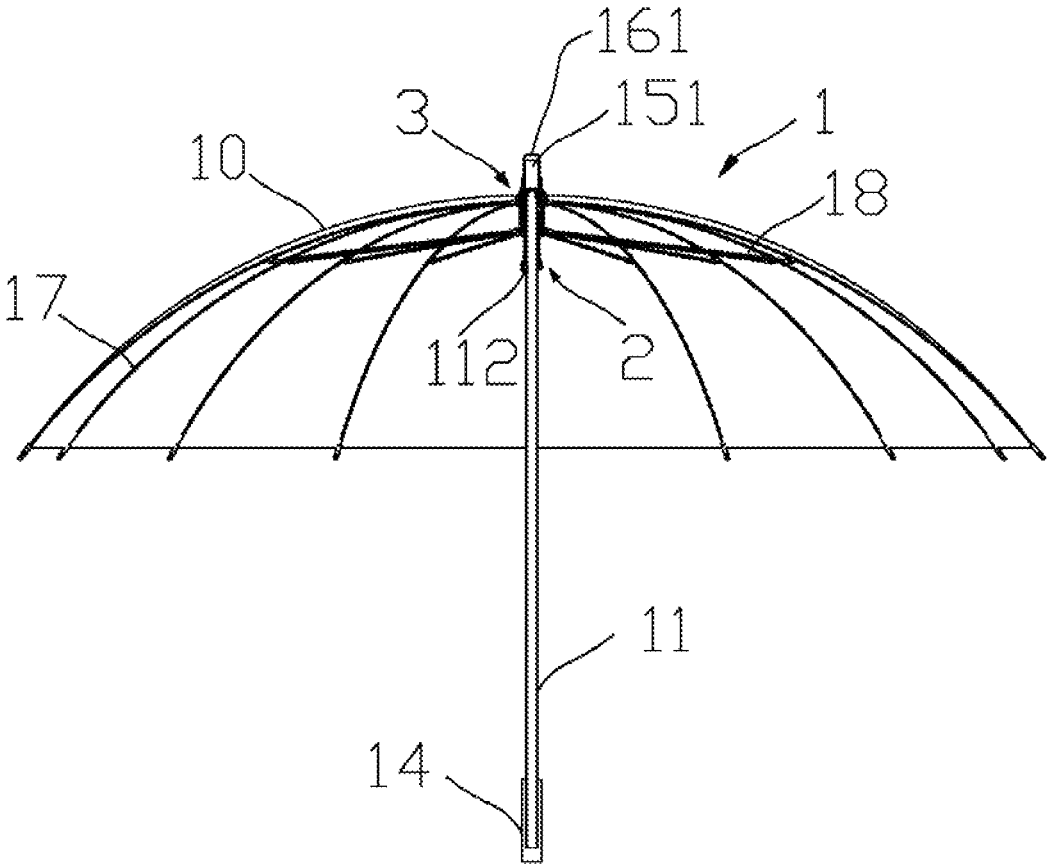
FIG. 19 illustrates structure of the luminous umbrella constructed in accordance with the fourth embodiment of the present invention.
Figure 20:
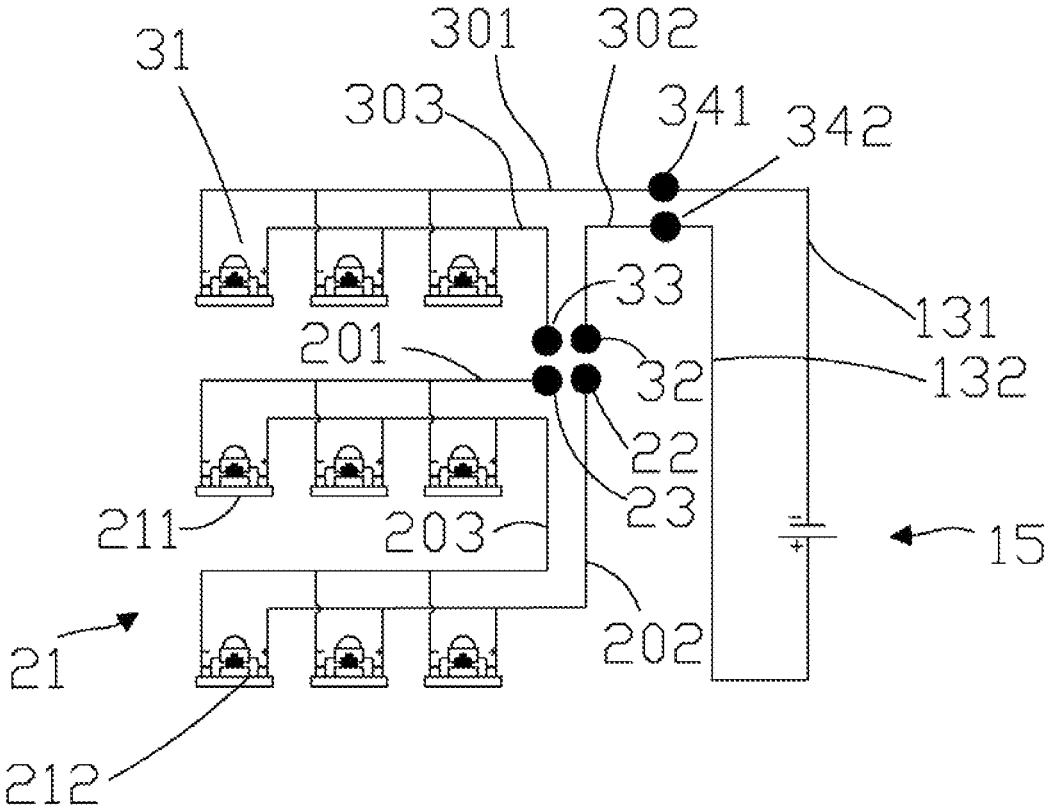
FIG. 20 illustrates the circuit diagram used in the fourth embodiment of the present invention.
Figure 21A:
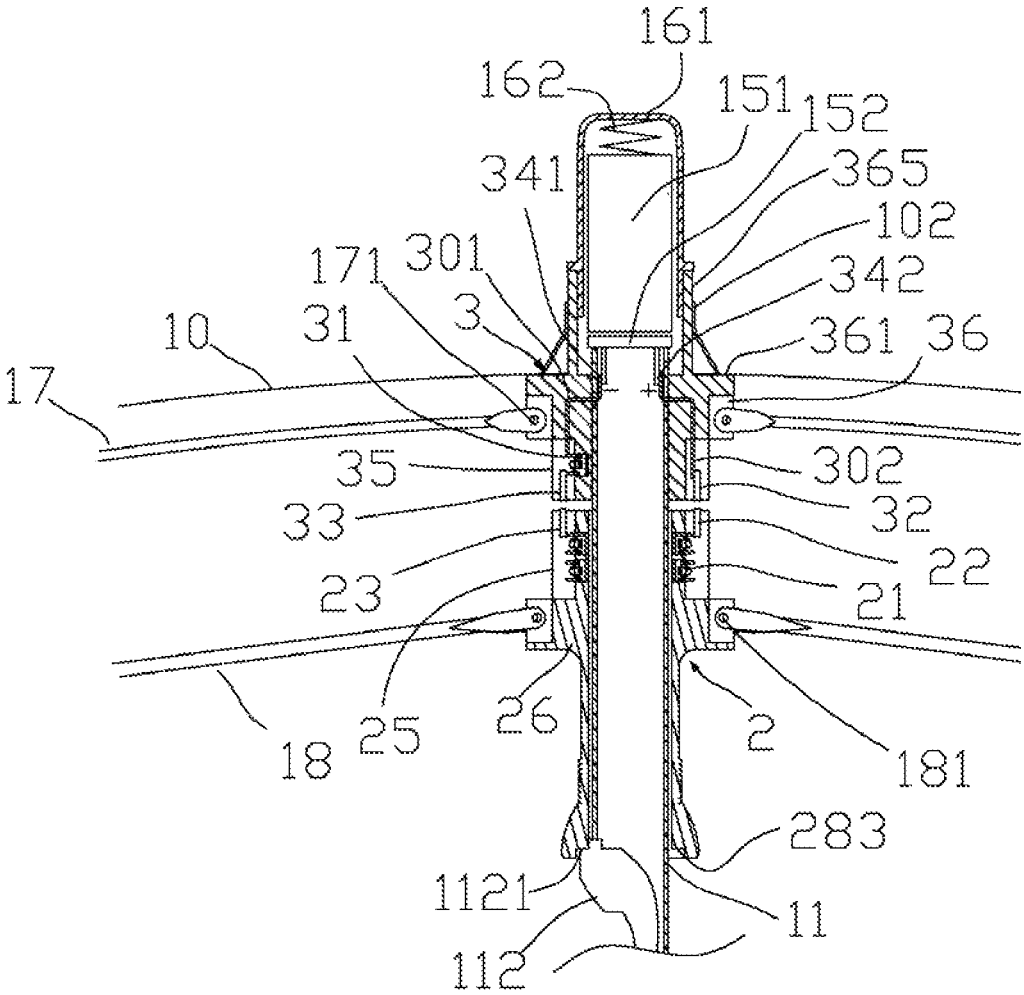
FIG. 21(*a*) illustrates the detailed structure of the illumination device used in the fourth embodiment of the present invention. The umbrella is opened with an open circuit.
Figure 21B:
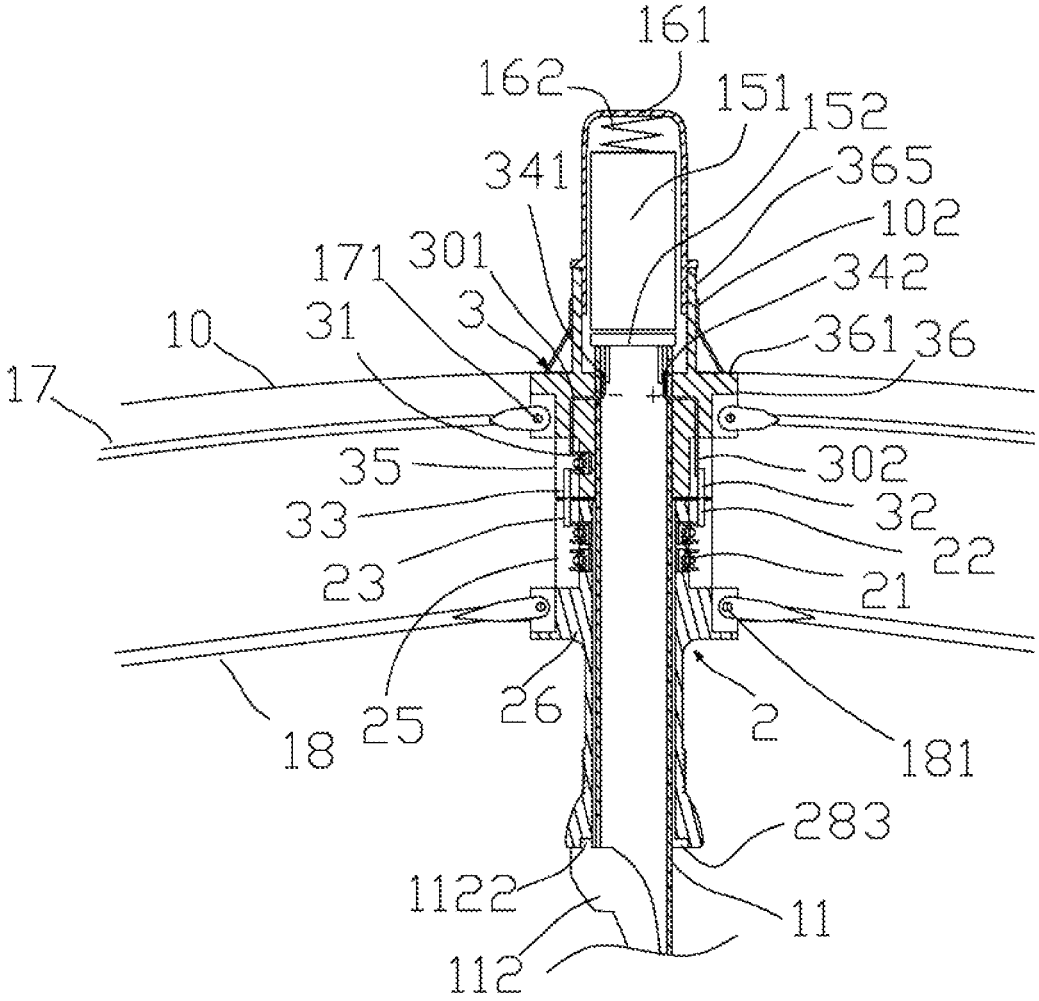

1 lu luminous umbrella
10 f flexible canopy
101 fixed cover of flexible canopy
102 fixed cover of flexible canopy
11 s shaft
111 plate spring
112 plate spring
1121 open position of plate spring
1122 close position of plate spring
113 plate spring
12 pr pressing switch
13 el electric wire
131 electric wire
132 electric wire
133 electric wire
134 electric wire
14 h handle
15 battery
151 battery
152 holder of battery
16 top column
161 top column
162 spring
17 ribs
171 fixed pin of ribs
18 linkages
181 fixed pin of linkages
2 linkage members on slip ring assembly
201 wire on slip ring
202 wire on slip ring
203 wire on slip ring
21 LED assembly on slip ring
211 LED assembly on slip ring
212 LED assembly on slip ring
22 electric contact on slip ring
23 electric contact on slip ring
25 transparent package of LED assembly on slip ring
26 out surface of slip ring
262 bottom circumferential surface of slip ring
263 middle circumferential surface of slip ring
264 top circumferential surface of slip ring
265 holding surface of slip ring

266 adhering surface of LED substrate at top circumferential surface of slip ring
27 central hole of slip ring for shaft
28 circumferential slots of slip ring
281 radial slots of slip ring
282 radial slots of slip ring
283 open slot of slip ring
3 rib members on fixed collar assembly
301 electric wire on fixed collar
302 electric wire on fixed collar
303 electric wire on fixed collar
31 LED assembly on fixed collar
32 electric contact on fixed collar
33 electric contact on fixed collar
341 power wire contact on fixed collar
342 power wire contact on fixed collar
35 transparent package of LED assembly on fixed collar
36 out surface of fixed collar
361 top surface of fixed collar
362 bottom circumferential surface of fixed collar
363 middle circumferential surface of fixed collar
364 top circumferential surface of fixed collar
365 top circumferential surface of fixed collar
37 central hole of fixed collar for shaft
38 circumferential slots of fixed collar
381 radial slots of fixed collar
382 radial slots of fixed collar
383 electric wire slots of fixed collar
384 electric wire slots of fixed collar
391 pin hole
392 feed through hole of electric wire on fixed collar
393 feed through hole of electric wire on fixed collar
4 illumination emitter of LED
41 transparent package of illumination semiconductor
42 wire contact
43 wire contact
44 LED substrate
441 bottom surface of LED substrate
5 rib members on fixed collar assembly
501 electric wire on fixed collar
502 electric wire on fixed collar
503 electric wire on fixed collar
504 electric wire on fixed collar
51 LED assembly on fixed collar
511 LED assembly on fixed collar
512 LED assembly on fixed collar
513 LED assembly on fixed collar
521 electric contact on fixed collar
522 electric contact on fixed collar
523 electric contact on fixed collar
551 transparent package of LED assembly on fixed collar
552 transparent package of LED assembly on fixed collar
561 top surface of fixed collar
562 bottom circumferential surface of fixed collar
563 top circumferential surface of fixed collar
564 extension circumferential surface of fixed collar
565 middle circumferential surface of fixed collar
58 circumferential slots of fixed collar
581 radial slots of fixed collar
582 radial slots of fixed collar
583 electric wire slots of fixed collar
591 feed through hole of electric wire on fixed collar
592 feed through hole of electric wire on fixed collar
593 pin hole
6 linkage members on slip ring assembly
601 wire on slip ring
621 electric contact on slip ring
623 electric contact on slip ring
65 transparent package of LED assembly on slip ring
661 top circumferential surface of slip ring
662 middle circumferential surface of slip ring
663 bottom circumferential surface of slip ring
664 holding surface of slip ring
67 central hole of slip ring for shaft
68 circumferential slots of slip ring
681 radial slots of slip ring
682 radial slots of slip ring
69 switch assembly of slip ring
691 wire contact
692 electric wire
693 wire contact
695 protective package
696 circumferential surface of switch assembly of slip ring
7 rib members on fixed collar assembly
721 electric contact on fixed collar
722 electric contact on fixed collar
75 transparent package of LED assembly on fixed collar
761 top surface of fixed collar
762 top circumferential surface of fixed collar
763 middle circumferential surface of fixed collar
764 bottom circumferential surface of fixed collar
78 circumferential slots of fixed collar
781 radial slots of fixed collar
782 radial slots of fixed collar
79 switch assembly of fixed collar
791 electric contact of fixed ring switch
792 electric contact of fixed ring switch
793 power wire contact of fixed ring switch
794 power wire contact of fixed ring switch
795 transparent resin package for fixed ring switch
796 circumferential surface on fixed ring switch
797 pin hole
8 linkage members on slip ring assembly
801 wire on slip ring
802 wire on slip ring
803 wire on slip ring
804 wire on slip ring
transparent resin package for LED assembly on slip ring
811 LED assembly on slip ring
812 LED assembly on slip ring
813 LED assembly on slip ring
821 electric contact on slip ring
822 electric contact on slip ring
851 transparent package of LED assembly on slip ring
852 transparent package of LED assembly on slip ring
861 top circumferential surface of slip ring
862 middle circumferential surface of slip ring
863 bottom circumferential surface of slip ring
864 holding surface of slip ring
88 circumferential slots of slip ring
881 radial slots of slip ring
882 radial slots of slip ring
9 umbrella handle illumination assembly
91 LED assembly
921 electric circuit fixed contact
922 electric circuit fixed contact
94 heat dissipating fin
95 transparent package of LED assembly
961 top surface with thread
962 bottom circumference surface
97 central hole of handle

What is claimed is:

1. A kind of improved structure of luminous umbrella having a flexible canopy, a shaft, a plate spring, a pressing switch, electric wire, a handle, a battery, a top column, ribs, linkages, the luminous umbrella comprising:

linkage members on a slip ring assembly;

rib members on a fixed collar assembly; and an umbrella handle illumination assembly, allowing light to be projected to an inner section of the canopy and to illuminate roads ahead for users, said linkage members on said slip ring assembly comprising a base, an LED assembly on a slip ring, insulation wire, multiple electric contacts on a slip ring and a transparent package, said base being made of materials with high heat dissipation capability to provide a heat dissipation function, said LED assembly on said slip ring and related circuit set being fitted on a surface of the base and protected with the transparent package, said surface of the base being composed of multiple annular surfaces of different diameters, said LED assembly on said slip ring and said insulation wire being installed on a top circumferential surface of said slip ring, wherein multiple slots are created on a middle circumferential surface of said slip ring for installation of said linkages as well as for heat dissipation, said heat dissipation function being provided at least by a bottom circumferential surface of said slip ring and a holding surface of said slip ring, said LED assembly on said slip ring comprising multiple sets of illumination emitter of LED and circuits linked together via a combination of series and parallel connections, wherein two end points of the circuit on said LED assembly on said slip ring connect to electric contacts on said slip ring, which are further connected with electric contacts on said fixed collar to form a circuit switch, the flexible canopy can be opened and closed with said linkage members on said slip ring assembly sliding up and down along the shaft, wherein light of the illumination emitter of LED is projected to an inner section of the flexible canopy when said circuit is activated, said rib members on said fixed collar assembly comprising a base, a LED assembly on said fixed collar, insulation wire, multiple electric contacts on said fixed collar and transparent package, said base being made of materials with high heat dissipation capability to offer the heat dissipation function, said LED assembly on said fixed collar and related circuit set being fitted on a bottom circumferential surface of said fixed collar and protected with the transparent package, said surface of the base being composed of multiple annular surfaces of different diameters, wherein multiple slots are created on a middle circumferential surface of said fixed collar for installation of said ribs, on which the flexible canopy can be fitted, said multiple slots also providing said heat dissipation function, said LED assembly on said fixed collar being composed of multiple sets of illumination emitter of LED and circuits linked together via a combination of series and parallel connections, wherein two end points of the circuit on said LED assembly on said fixed collar connect to electric contacts on said fixed collar and wire contacts, which are further connected with electric wires, said electric contacts on said fixed collar being used to connect to said electric contacts on said slip ring to form a circuit switch, wherein light of the illumination emitter of LED is projected to the inner section of the flexible canopy when the circuit is activated, said umbrella handle illumination assembly comprising a base, LED assembly, insulation wire, wire contact and transparent package, said base being made of materials with high heat dissipation capability to provide the heat dissipation function, wherein a surface of the base is composed of multiple annular surfaces of different diameters, wherein a top circumference surface is used for connection with the handle and heat dissipating fins are fitted on a middle circumference surface to provide said heat dissipation function, said LED assembly and said insulation wire are fitted on a bottom circumference surface, said LED assembly being composed of multiple sets of illumination emitter of LED and circuits linked together via a combination of series and parallel connections, wherein two end points of the circuit on said LED assembly connect to wire contacts, which are further connected with electric wires, wherein light is able to illuminate the roads ahead for users when the circuit is activated, said electric contacts on said slip ring coming into contact with said electric contacts on said fixed collar to form a closed-loop circuit when the umbrella is opened, the circuit being activated and the LED illumination device lighting up to project light to the inner section of flexible canopy and illuminating the roads ahead for users when the pressing switch is in a closed state, the circuit being an open circuit and said circuit not being activated when the umbrella is closed.

2. The improved structure of luminous umbrella as claimed in claim 1, wherein illumination emitters of LED are placed on different out surfaces of said slip ring and interconnected with wires via multiple holes and slots on the base.

3. The improved structure of luminous umbrella as claimed in claim 1, wherein multiple annular surfaces of the bases of said linkage members on said slip ring assembly, said rib members on said fixed collar assembly and said umbrella handle illumination assembly can be formed in flat, oblique, cylindrical, conical or circular shapes depending on the directions of light to be projected by illumination emitters of LED.

4. The improved structure of luminous umbrella as claimed in claim 1, wherein the wire contacts on said linkage members on said slip ring assembly, said rib members on said fixed collar assembly and said umbrella handle illumination assembly are created in flexible copper conductor structure to ensure high conductivity between electric contacts on said slip ring and electric contacts on said fixed collar.

5. The improved structure of luminous umbrella as claimed in claim 1, wherein said two end points of the circuit of said LED assembly on said fixed collar on the rib members on said fixed collar assembly connect to said electric contacts on said fixed collar and wire contacts, which further connect to an internal battery or an external power source to constitute a closed-loop circuit, wherein a state of the circuit, being open or closed, can be controlled with the pressing switch.

6. The improved structure of luminous umbrella as claimed in claim 1, wherein two end points of the circuit of said LED assembly on said slip ring on the linkage members on said slip ring assembly connect to electric contacts on said slip ring and said wire contacts, which further connect to internal battery or external power source to constitute a closed-loop circuit, wherein a state of the circuit, being open or closed, can be controlled with the pressing switch.

7. The improved structure of luminous umbrella as claimed in claim 1, wherein the circuit switch is formed with said contacts on the linkage members on said slip ring assembly and the rib members on said fixed collar assembly, the contacts coming into contact with one another to constitute a closed-loop circuit when the umbrella is opened, the circuit being an open circuit when the umbrella is closed, whereby said LED illumination device on the umbrella can be controlled.

* * * * *